US007434923B2

(12) United States Patent
Miyazawa et al.

(10) Patent No.: US 7,434,923 B2
(45) **Date of Patent: *Oct. 14, 2008**

(54) INK CARTRIDGE AND METHOD OF REGULATING FLUID FLOW

(75) Inventors: Hisashi Miyazawa, Nagano (JP); Atsushi Kobayashi, Nagano (JP); Satoshi Shinada, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 510 days.

This patent is subject to a terminal disclaimer.

(21) Appl. No.: 11/153,119

(22) Filed: Jun. 15, 2005

(65) Prior Publication Data

US 2005/0231571 A1 Oct. 20, 2005

Related U.S. Application Data

(63) Continuation of application No. 10/367,232, filed on Feb. 14, 2003, now Pat. No. 7,011,397.

(30) Foreign Application Priority Data

| | | |
|---|---|---|
| Sep. 12, 2002 | (JP) | 2002-266824 |
| Oct. 4, 2002 | (JP) | 2002-292337 |
| Dec. 6, 2002 | (JP) | 2002-355470 |
| Dec. 9, 2002 | (JP) | 2002-357040 |

(51) Int. Cl.
*B41J 2/175* (2006.01)

(52) U.S. Cl. ..... 347/86; 347/85

(58) Field of Classification Search ..... 347/84, 347/85, 86, 87

See application file for complete search history.

(56) References Cited

U.S. PATENT DOCUMENTS

| | | | |
|---|---|---|---|
| 2,526,019 | A | 10/1950 | Fowler |
| 3,270,771 | A | 9/1966 | Morgan et al. |
| 3,354,902 | A | 11/1967 | Obermaier |
| 3,779,274 | A | 12/1973 | Kelly |
| 3,941,149 | A | 3/1976 | Mittleman |
| 4,152,710 | A | 5/1979 | Matsuba et al. |

(Continued)

FOREIGN PATENT DOCUMENTS

| | | |
|---|---|---|
| DE | 1 009 870 | 6/1955 |

(Continued)

OTHER PUBLICATIONS

Notice of Investigation of the U.S. International Trade Commission in the Matter of Certain Ink Cartridges and Components Thereof, Inv. No. 337-TA-565 (Mar. 17, 2006) (unsigned).

(Continued)

*Primary Examiner*—Anh T. N. Vo
(74) *Attorney, Agent, or Firm*—Stroock & Stroock & Lavan LLP

(57) ABSTRACT

In an ink cartridge, a negative pressure generating mechanism is disposed between an ink storage region and an ink supply port, and has a wall surface having two through-holes for ink flow, and a valve member contacted with and separated from the through-hole by receiving a pressure in an ink supply port side. Ink flowing via the through-hole is supplied via the through-hole to the ink supply port.

15 Claims, 21 Drawing Sheets

U.S. PATENT DOCUMENTS 4,162,501 A 7/1979 Mitchell et al.
4,183,031 A 1/1980 Kyser et al.
4,306,245 A 12/1981 Kasugayama et al.
4,368,478 A 1/1983 Koto
4,436,439 A 3/1984 Koto
4,511,906 A 4/1985 Hara
4,514,742 A 4/1985 Suga et al.
4,520,369 A 5/1985 Shackleton
4,545,694 A 10/1985 Ninomiya et al.
4,602,662 A 7/1986 Eremity et al.
4,677,447 A 6/1987 Nielson
4,700,202 A 10/1987 Kuranishi et al.
4,771,295 A 9/1988 Baker et al.
4,869,282 A 9/1989 Sittler et al.
4,893,138 A 1/1990 Terasawa et al.
4,929,109 A 5/1990 Ikenaga
4,971,527 A 11/1990 Dick
5,039,997 A 8/1991 Pullen et al.
5,040,002 A 8/1991 Pollacek et al.
5,138,344 A 8/1992 Ujita
5,155,502 A 10/1992 Kimura et al.
5,280,300 A 1/1994 Fong et al.
5,300,959 A 4/1994 McClelland et al.
5,305,795 A 4/1994 Forberg
5,343,226 A 8/1994 Niedermeyer et al.
5,367,328 A 11/1994 Erickson
5,388,615 A 2/1995 Edlund et al.
5,426,459 A 6/1995 Kaplinsky
5,453,772 A 9/1995 Aono et al.
5,461,482 A 10/1995 Wilson et al.
5,477,963 A 12/1995 Mochizuki et al.
5,500,663 A 3/1996 Ujita et al.
5,506,611 A 4/1996 Ujita
5,539,437 A 7/1996 Penwell
5,610,635 A 3/1997 Murray
5,619,237 A 4/1997 Inoue et al.
5,633,666 A 5/1997 Haigo
5,646,664 A 7/1997 Pawlowski, Jr.
5,653,251 A 8/1997 Handler
5,657,058 A 8/1997 Mochizuki et al.
5,691,753 A 11/1997 Hilton
5,736,992 A 4/1998 Pawlowski, Jr.
5,737,001 A 4/1998 Taylor
5,751,319 A 5/1998 Robertson et al.
5,777,646 A 7/1998 Barinaga et al.
5,788,388 A 8/1998 Cowger et al.
5,796,419 A 8/1998 Clark et al.
5,969,737 A 10/1999 Koyama et al.
6,000,788 A 12/1999 Iida
6,010,211 A 1/2000 Betschon
6,074,042 A 6/2000 Gasvoda et al.
6,102,508 A 8/2000 Cowger
6,130,696 A 10/2000 Mashita et al.
6,183,077 B1 2/2001 Hmelar et al.
6,193,364 B1 2/2001 Iida
6,217,146 B1 4/2001 Takahashi et al.
6,231,173 B1 5/2001 Pawlowski, Jr. et al.
6,238,042 B1 5/2001 Kobayashi et al.
6,293,662 B1 9/2001 Shihoh et al.
6,302,531 B1 10/2001 Usui et al.
6,332,481 B1 12/2001 Shinada et al.
6,338,104 B1 1/2002 Iwasaki
6,361,136 B1 3/2002 Watanabe et al.
6,383,436 B1 5/2002 Nishimuro et al.
6,390,611 B1 5/2002 Kobayashi et al.
6,416,152 B1 7/2002 Matsuzaki et al.
6,422,691 B2 7/2002 Kobayashi et al.
6,431,699 B2 8/2002 Shihoh et al.
6,435,649 B2 8/2002 Takahashi et al.
6,460,984 B1 10/2002 Matsumoto et al.
6,550,901 B2 * 4/2003 Iida ..... 347/86
6,585,358 B2 7/2003 Usui et al.
6,648,459 B2 11/2003 Usui et al.
6,666,551 B2 12/2003 Kobayashi et al.
6,837,575 B2 1/2005 Usui
6,955,422 B2 10/2005 Miyazawa et al.
7,011,397 B2 * 3/2006 Miyazawa et al. ..... 347/86
7,014,286 B2 3/2006 Yonekubo
7,014,304 B2 3/2006 Sasaki
7,019,857 B2 3/2006 Abe
7,020,414 B2 3/2006 Ito et al.
2001/0006396 A1 7/2001 Iida
2001/0043253 A1 11/2001 Silverbrook
2001/0055041 A1 12/2001 Yonekubo
2002/0089083 A1 7/2002 Nishimuro et al.
2002/0109760 A1 8/2002 Miyazawa et al.
2002/0135646 A1 9/2002 Usui
2002/0154200 A1 10/2002 Miyazawa et al.
2002/0158948 A1 10/2002 Miyazawa et al.
2002/0171721 A1 11/2002 Ota et al.
2002/0171722 A1 11/2002 Hara et al.
2002/0171723 A1 11/2002 Ota et al.
2002/0180849 A1 12/2002 Sakai et al.
2003/0007043 A1 1/2003 Ota et al.
2003/0058312 A1 3/2003 Iida
2003/0058313 A1 3/2003 Iida
2003/0085970 A1 5/2003 Sakai et al.
2003/0103119 A1 6/2003 Sakai et al.
2003/0107627 A1 6/2003 Seino et al.
2003/0107629 A1 6/2003 Kobayashi et al.
2003/0128261 A1 7/2003 Usui et al.
2003/0146959 A1 8/2003 Iida
2004/0056936 A1 3/2004 Usui et al.
2004/0085415 A1 5/2004 Kobayashi et al.

FOREIGN PATENT DOCUMENTS

DE 1 152 583 9/1958
DE 1 852 284 11/1961
DE 1 550 194 8/1969
DE 2 230 642 12/1972
DE 3 202 796 A1 8/1983
DE 32 27 589 1/1984
DE 195 45 775 A1 6/1997
EP 0 112 701 A2 7/1984
EP 0 116 466 A2 8/1984
EP 0 238 829 A2 9/1987
EP 0 336 307 A2 10/1989
EP 0 339 770 A2 11/1989
EP 0 412 643 A1 2/1991
EP 0 424 133 A2 4/1991
EP 0 509 686 A2 10/1992
EP 0 529 880 B1 3/1993
EP 0 562 717 A1 9/1993
EP 0 631 874 A2 1/1995
EP 0 709 207 A2 5/1996
EP 0 760 288 A1 3/1997
EP 0 794 059 A2 9/1997
EP 0 812 693 A1 12/1997
EP 0 827 836 A1 3/1998
EP 0 839 660 A1 5/1998
EP 0 879 702 A2 11/1998
EP 0 903 236 A2 3/1999
EP 0 919 384 A2 6/1999
EP 0 956 958 A2 11/1999
EP 1 016 533 A1 7/2000
EP 1 125 747 A2 8/2001
EP 1 199 178 A1 4/2002
EP 1 258 358 A1 11/2002
EP 1 270 235 A1 1/2003
FR 1 145 605 10/1957
FR 1 268 227 7/1961
FR 2 391 405 A1 12/1978
GB 751 289 6/1956

| | | | |
|---|---|---|---|
| GB | 2 147 975 | | 5/1985 |
| GB | 2 323 332 | A | 9/1998 |
| JP | 54-57530 | U | 4/1979 |
| JP | 55-146766 | | 11/1980 |
| JP | 56-013183 | | 2/1981 |
| JP | 57-006777 | | 1/1982 |
| JP | 57-197176 | A | 12/1982 |
| JP | 58-036457 | A | 3/1983 |
| JP | 59-176545 | | 10/1984 |
| JP | 62-231759 | | 10/1987 |
| JP | 02-072271 | | 3/1990 |
| JP | 02-198862 | | 8/1990 |
| JP | 04-073158 | | 3/1992 |
| JP | 92/12371 | | 7/1992 |
| JP | 05-050609 | | 3/1993 |
| JP | 05-162324 | A | 6/1993 |
| JP | 05-201018 | | 8/1993 |
| JP | 05-229137 | | 9/1993 |
| JP | 08-174860 | A | 7/1996 |
| JP | 9-11500 | A | 1/1997 |
| JP | 09-290514 | | 11/1997 |
| JP | 10-086402 | | 4/1998 |
| JP | 10-244685 | | 9/1998 |
| JP | 10-281332 | A | 10/1998 |
| JP | 10-315504 | | 12/1998 |
| JP | 11-058772 | | 3/1999 |
| JP | 11-091122 | | 4/1999 |
| JP | 11-170558 | A | 6/1999 |
| JP | 11-179932 | | 7/1999 |
| JP | 2001-270129 | | 10/2001 |
| JP | 2002-103642 | | 4/2002 |
| JP | 2002-234196 | A | 8/2002 |
| WO | 00/03877 | A1 | 1/2000 |
| WO | 01/78988 | A1 | 10/2001 |
| WO | 02/04217 | A1 | 1/2002 |

OTHER PUBLICATIONS

Respondent Ninestar Technology Co. Ltd.'s (Zhuhai) Third Supplemental Responses to Complainant's First and Second Sets of Interrogatories (Nos. 16-19 . . . and 146) (including Exhibits A-C), U.S. ITC Investigation No. 337-TA-565 (Aug. 18, 2006).

Respondent Ninestar Technology Co. Ltd.'s Third Supplemental Responses to Complainant's First and Second Set of Interrogatories (Nos. 21-24 . . . 138-145), U.S. ITC Investigation No. 337-TA-565 (Aug. 18, 2006).

Respondent Town Sky Inc.'s Third Supplemental Responses to Complainant's First and Second Set of Interrogatories (Nos. 21-24 . . . 138-145), U.S. ITC Investigation No. 337-TA-565 (Aug. 18. 2006).

Respondent Dataproducts USA LLC's Second Supplemental Objections and Responses to Complainant's First Set of Interrogatories, U.S. ITC Investigation No. 337-TA-565 (Aug. 16, 2006).

Respondent Dataproducts USA LLC's Second Supplemental Objections and Responses to Complainant's Second Set of Interrogatories, U.S. ITC Investigation No. 337-TA-565 (Aug. 16, 2006).

Artech's Preliminary Proposed Claim Constructions, ITC Inv. No. 337-TA-565 (3 pgs.).

Artech's Preliminary Non-Infringement Claim Charts, ITC Inv. No. 337-TA-565 (18 pgs.).

Artech's Preliminary Invalidity Claim Charts, ITC Inv. No. 337-TA-565 (20 pgs.).

Search Report in European Patent Appln. No. 03 093 485.4, mailed Feb. 18, 2004.

Combined Search and Examination Report in GB Appln. No. 0303189.5, mailed Jun. 3, 2003.

U.S. Appl. No. 09/525,477, filed Mar. 15, 2000, Miyazawa.

U.S. Appl. No. 10/778,766, filed Feb. 13, 2004, Miyazawa et al.

U.S. Appl. No. 10/819,756, filed Apr. 6, 2004, Miyazawa.

U.S. Appl. No. 10/826,918, filed Apr. 16, 2004, Miyazawa et al.

* cited by examiner 59
61'
67
100
62'
W
120
103
84
102
104
65
50'
53
54
55
121
130
110
111

INK CARTRIDGE AND METHOD OF REGULATING FLUID FLOW

CROSS-REFERENCE TO RELATED APPLICATION

This application is a continuation of copending application Ser. No. 10/367,232, filed on Feb. 14, 2003.

BACKGROUND OF THE INVENTION

The present invention relates to an ink cartridge for supplying ink in a proper negative pressure state to a recording head that ejects ink droplets in response to print signals.

This invention also involves a method for regulating the flow of fluid from an ink cartridge to an ink jet head.

An ink jet recording apparatus is generally configured such that an ink jet recording head for ejecting ink droplets in response to print signals is mounted on a carriage reciprocating in a sheet width direction across a piece of recording paper, and ink is supplied from an external ink tank to the recording head. In case of a small recording apparatus, an ink storage container such as an ink tank is arranged to be removable from the carriage in view of convenience in handling and to facilitate replacement of an exhausted ink tank with a fresh ink tank containing a new supply of ink (or inks, if the tank is a multi-color tank).

In order to prevent leakage of ink from the recording head, such an ink storage container generally includes therein a porous member impregnated with ink so that the capillary force of the porous member holds the ink.

In addition, there is a tendency for the amount of ink consumed to increase, with time, because the continuing development of improved printers leads to an increased number of nozzle openings in order to keep pace with required improvement in print quality and print speed.

In order to accommodate these developments in ink jet printer design, it is preferable to increase the amount of ink that can be stored in the ink storage container, but this leads to an increase in the volume of the porous member. However, in the case where the porous member that holds the ink employs capillary force, the height, i.e. water head, of the porous member is limited, and therefore the bottom area of the ink storage container must be increased in order to increase the container's volume, causing a problem in which the carriage size and thus entire size of the recording apparatus must be increased.

To solve this problem, Japanese Patent Kokai Publication No. Hei. 8-174860 proposes, at paragraphs 0041-0043, and FIG. 10, an ink cartridge in which a membrane member deformable by ink pressure is formed at its center with a through-hole to provide a membrane valve seat, and a valve member is provided at a location opposing the membrane valve seat.

Also to solve this problem, International Patent Publication No. PCT00/03877 proposes an ink cartridge in which a valve member is formed by injection molding of polymer material having elasticity, a through-hole is formed in a center of the valve member, a back surface of the valve member is pressingly contacted with a sealing member by a spring, and the valve member is moved by a negative pressure acting on the back surface of the valve member so that ink flows out via the through-hole to an ink supply port.

Meanwhile, an ink cartridge having high ink supply performance and which can supply a large amount of ink to a recording head, is needed in order to satisfy the need for such cartridges when used in high speed printing. The most important factor affecting the performance when supplying ink to a recording head is the flow passage resistance within the cartridge.

U.S. Pat. No. 4,602,662 describes an externally-controlled valve for use in liquid marking systems. This reference teaches that an inlet and outlet are located on one side of a movable member, and a spring and external vacuum source are located on the other side of the movable member. The patent specifically states that the spring is not used to seal the valve, but rather, is provided only to prevent siphoning, and the external vacuum source serves to keep the valve closed.

U.S. Pat. No. 4,971,527 involves a regulator valve for an ink marking system. A diaphragm is pressed between two springs and so serves to dampen pressure pulsations in the ink flowing between an inlet and outlet located on one side of the diaphragm.

U.S. Pat. No. 5,653,251 relates to a vacuum actuated sheath valve. While an inlet and outlet are located on the same side of the valve membrane, that membrane itself can perforated, allowing liquid to pass to the other side of the membrane. Moreover, the membrane is stretched over a curved projection, and no spring is used to regulating the valve "cracking" pressure. More specifically, U.S. Pat. No. 5,653,251 discloses a valve structure having a valve member made of an elastically deformable membrane, a convex portion with which the valve member is contactable, and a flow channel formed in the convex portion and closable by the valve member. In the valve structure, negative pressure at the demand side is applied to one surface of the valve member to separate the valve member from the flow channel, to thereby control supply and interruption of the liquid. However, in the valve open state, the area of the valve member receiving the liquid pressure (the pressure-receiving area) is extremely small, meaning that the difference in area between the front and back surfaces of the valve member is large. For this reason, the valve open state cannot be maintained by the small pressure change which results from ink consumption by the recording head. When the valve structure is put into the valve closed state, the pressure-receiving area is extremely large, so that the valve structure is returned to the valve open state. Accordingly, there is a problem in that this operation is undesirably repeated to cause pulsations during the supply of ink, which, it will be appreciated, can adversely affect printing.

In the ink cartridge disclosed in International Patent Publication No. PCT00/03877, the through-hole, which forms an ink flow passage through the membrane member, causes a fluidic resistance, and further, a mutual clearance of the through-hole with respect to the valve member cooperating with the through-hole also causes a large fluidic resistance.

European Patent Application No. 1 199 178 describes an ink cartridge having a differential pressure valve mechanism (U.S. Patent Application Publn. No. 2002/0109760 is a counterpart). This reference describes valves in which a perforation in a movable membrane is urged by a spring to abut a solid projection.

To reduce the fluidic resistance caused by the through-hole of the membrane member, it is conceivable to make the diameter of the through-hole larger, but since the membrane member must be formed from elastic polymer material, increasing the size of the through-hole will reduce the load per unit area, causing a decrease in the sealing pressure, and thus degrading the valve's sealing ability and reducing cartridge performance.

For this reason, a modification can be made wherein a protruding portion is formed in the region of the valve member opposing the sealing member to improve the sealing ability, and the through-hole is formed through this protruding portion. However, due to the biasing force of the spring, when the valve is maintained in the closed state, the protruding portion is elastically deformed and collapsed.

Consequently, even when negative pressure acts on the valve member to move the valve backward from the sealing member by an amount corresponding to the applied negative pressure, the protruding portion that has been elastically deformed is returned to the original state, and so a flow passage resistance at the valve open state is high. In the case where a large amount of ink is needed for consumption, such as when printing an image, there is a possibility that insufficient ink will be supplied.

Further, in order to stabilize the closed state of the valve member, the protruding portion needs to be sufficiently collapsed to be in close contact with the sealing member. To this end, the protruding portion of the valve member is constructed from an elastic member made of elastomer. Also, the protruding portion of the valve member is thick in comparison to a membrane surface of the valve member receiving the differential pressure. Therefore, a turbulent flow of resin is likely to occur during injection molding, and thus welds are likely to occur as a consequence of molding, causing difficulty in formation of the protruding portion of the valve member largely protruded from the membrane surface.

Moreover, since an offset in concentricity between the protruding portion of the valve member and the sealing member is caused due to fluctuation in component precision and assembly, the contact surface of the sealing member must be made large in comparison with the diameter of the valve member protruding portion in order to insure proper alignment.

Because of these considerations, the sealing member is present over a wide area around the protruding portion of the valve member, causing the problem of large flow passage resistance.

Further, because the through-hole must be formed through the protruding portion of the valve member, wrinkles or grooves due to welds are likely to occur in a sealing region, causing poor manufacture yields, which are undesirable.

Moreover, in the case where a through-hole configuration, such as a tapered configuration, is applied to the through-hole formed in the membrane member as an attempt to decrease a flow passage resistance, a lower portion of the protruded portion is small in wall thickness, causing a problem in which the protruded portion is deformed into the interior of the through-hole. That is, there is a further problem in that the configuration of the through-hole is limited.

SUMMARY OF THE INVENTION

The present invention was made, in part, in order to solve these problems.

An object of the present invention is to provide an ink cartridge that can reduce a flow passage resistance around a through-hole in a negative pressure generating structure, to thereby allow a high rate of ink consumption from the ink cartridge by a recording head.

Another object of the present invention is to provide an ink cartridge that can be manufactured with excellent yield.

Yet another object of the present invention is to provide a fluid flow controller for a recording head, which can reduce a flow passage resistance around a through-hole in a negative pressure generating structure, to thereby allow a high rate of ink consumption by the recording head.

In order to achieve the above-noted objects, an ink cartridge is constructed, which includes: an ink storage region, an ink supply port communicating with the ink storage region, and a negative pressure generating mechanism which opens in association with consumption of ink, wherein: the negative pressure generating mechanism includes: an ink supply flow passage forming member disposed between the ink storage region and the ink supply port, and forming an ink flow passage communicatable with the ink supply port; and an elastic member disposed in the ink supply flow passage forming member, and having a first surface receiving a pressure in the ink storage region via a first flow passage formed in the ink supply flow passage forming member and a second surface receiving a pressure in the ink supply port via a second flow passage formed in the ink supply flow passage forming member, so that the elastic member can be contacted with and separated from an opening portion of the ink flow passage by an elastic force; and the elastic member is moved to open the opening portion of the ink flow passage in association with the pressure in the ink supply port, to thereby supply ink to the ink supply port.

According to the above arrangement, it is possible to dispense with a through-hole formed in an elastic member, and therefore the elastic member can be constructed to have a substantially planar surface. Even if the elastic member is returned by the action of applied negative pressure, it is possible to eliminate a narrowed flow passage caused by the restoration of a protruding portion. Further, it is possible to avoid welds, which are likely to occur during injection molding, and thereby increase the manufacture yield.

Moreover, a region of an elastic member, which is used to seal an opening portion of an ink flow passage, can be formed as a planar surface. By virtue of this structure, a large clearance between the opening portion of the ink flow passage and the valve member can be ensured and a depth can also be shortened. For this reason, it is possible to reduce flow passage resistance to and so allow a high rate of ink consumption by a recording head. That is, it is possible to provide an ink cartridge suitable for high speed printing.

According to this invention, an ink cartridge is constructed having an ink storage region, an ink supply port communicating with the ink storage region, and a negative pressure generating mechanism which opens in association with consumption of ink, wherein: the ink storage region is divided into an upper part ink storage region sealed from the atmosphere, and an lower part ink storage region opened to the atmosphere, the upper and lower part ink storage regions mutually communicating with each other via a suction flow passage; the negative pressure generating mechanism is stored in the upper part ink storage region; the negative pressure generating mechanism includes: an ink supply flow passage forming member disposed between the upper part ink storage region and the ink supply port, and forming an ink flow passage communicatable with the ink supply port; and an elastic member disposed in the ink supply flow passage forming member, and having a first surface receiving a pressure in the ink storage region via a first flow passage formed in the ink supply flow passage forming member and a second surface receiving a pressure in the ink supply port via a second flow passage formed in the ink supply flow passage forming member, so that the elastic member can be contacted with and separated from an opening portion of the ink flow passage by an elastic force; and the elastic member is moved to open the opening portion of the ink flow passage in association with the pressure in the ink supply port, to thereby supply ink to the ink supply port.

According to this embodiment, an ink supply flow passage forming member can be readily formed by an injection molding integrally in a box shaped container main body having a bottom and forming an ink cartridge.

According to the present invention, an ink cartridge is provided, which includes: an ink storage chamber; an ink supply port that is in fluid communication with the ink storage chamber through an ink flow path; and a negative pressure generating mechanism which selectively blocks the ink flow path and opens as a consequence of consumption of ink, the ink negative pressure generating mechanism including an elastic member having first and second surfaces; an ink flow path communicating with the ink supply port and having an opening portion at a position where the first surface of the elastic member contacts with and separates from the opening portion; a communicating portion facing the first surface of the elastic member and communicating with the ink storage chamber; and a space portion facing the second surface of the elastic member and communicating with the ink supply port.

According to the above arrangement, since an opening area of the space portion is larger than that of the opening portion of the ink flow path communicating with the ink supply port, a pressure change at a downstream side, i.e. an ink supply port side, caused as a consequence of consumption of ink can be effectively applied to the elastic member so as to surely shift the elastic member into the valve open state.

In the above arrangement, a partition wall is disposed at an upstream side of the elastic member to define a compartment between the elastic member and the partition wall, the partition wall having a protruding portion which the first surface of the elastic member contacts elastically, and the opening portion of the ink flow path communicating with the ink supply port is formed in the protruding portion.

Accordingly, since a large space can be ensured around the protruding portion in an ink supply state in which the elastic member separates from the opening portion, it is possible to reduce a dynamic pressure loss caused in conjunction with the flow of ink. That is, the protruding portion can be formed from the same material as that of the container main body, a protruding amount (a height) of the protruding portion can be set as desired, and further, freedom in designing the shape of the protruding portion and the shape of the through-hole can be increased.

The present invention further provides a biasing member that is disposed opposite to the protruding portion and that urges the elastic member toward the protruding portion.

Accordingly, it is possible to assuredly put the elastic member in contact with the protruding portion regardless of the posture of the elastic member, to thereby maintain a seal therebetween regardless of whether external vibrations are received, such as vibrations caused by carriage movement. Further, the contact force (a sealing force) with which the elastic member presses against the protruding portion can be set to an optimal value, i.e. a value that can prevent the elastic member from contacting with and separating from the protruding portion due to the carriage movement, and that still can effectively supply ink, while maintaining an optimal negative pressure.

Further, the opening portion of the protruding portion is disposed to substantially face the center of the elastic member.

The central region of the elastic member maintains a substantially planar shape when the elastic member is deformed symmetrically with respect to a point, and therefore the central region of the elastic member can effectively seal the opening portion, to increase the sealing ability.

Moreover, this invention provides that the opening portion of the ink flow passage includes a cylindrical portion in an elastic member side and an enlarged portion enlarged in a direction of ink flow toward the ink supply port.

Accordingly, it is possible to ensure reliable sealing by the cylindrical region, and reduce the entire flow passage resistance by the enlarged portion.

The invention further provides a fluid flow controller for a recording head, which includes: an elastic member having first and second surfaces, and movable by a pressure differential between the first and second surfaces; a communicating portion facing the first surface of the elastic member and adapted to communicate with an ink tank storing ink therein; an ink outflow port; an opening portion of an ink flow path, which communicates with the ink outflow port, wherein the first surface of the elastic member contacts with and separated from the opening portion; and a space portion facing the second surface of the elastic member and communicating with the ink outflow port.

According to the above arrangement, since an opening area of the space portion is larger than that of the opening portion of the ink flow path communicating with the ink outflow port, a pressure change at a downstream side, i.e. an ink outflow port side, caused as a consequence of consumption of ink can be effectively applied to the elastic member so as to surely shift the elastic member into the valve open state.

The present disclosure relates to the subject matter contained in Japanese patent application No. 2002-266824 (filed on Sep. 12, 2002), 2002-292337 (filed on Oct. 4, 2002), 2002-355470 (filed on Dec. 6, 2002) and 2002-357040 (filed on Dec. 9, 2002), each of which are expressly incorporated herein by reference in their entireties.

DESCRIPTION OF THE PREFERRED EMBODIMENT

Hereafter, the details of the present invention will be discussed with reference to the illustrated embodiments.

Figure 1:
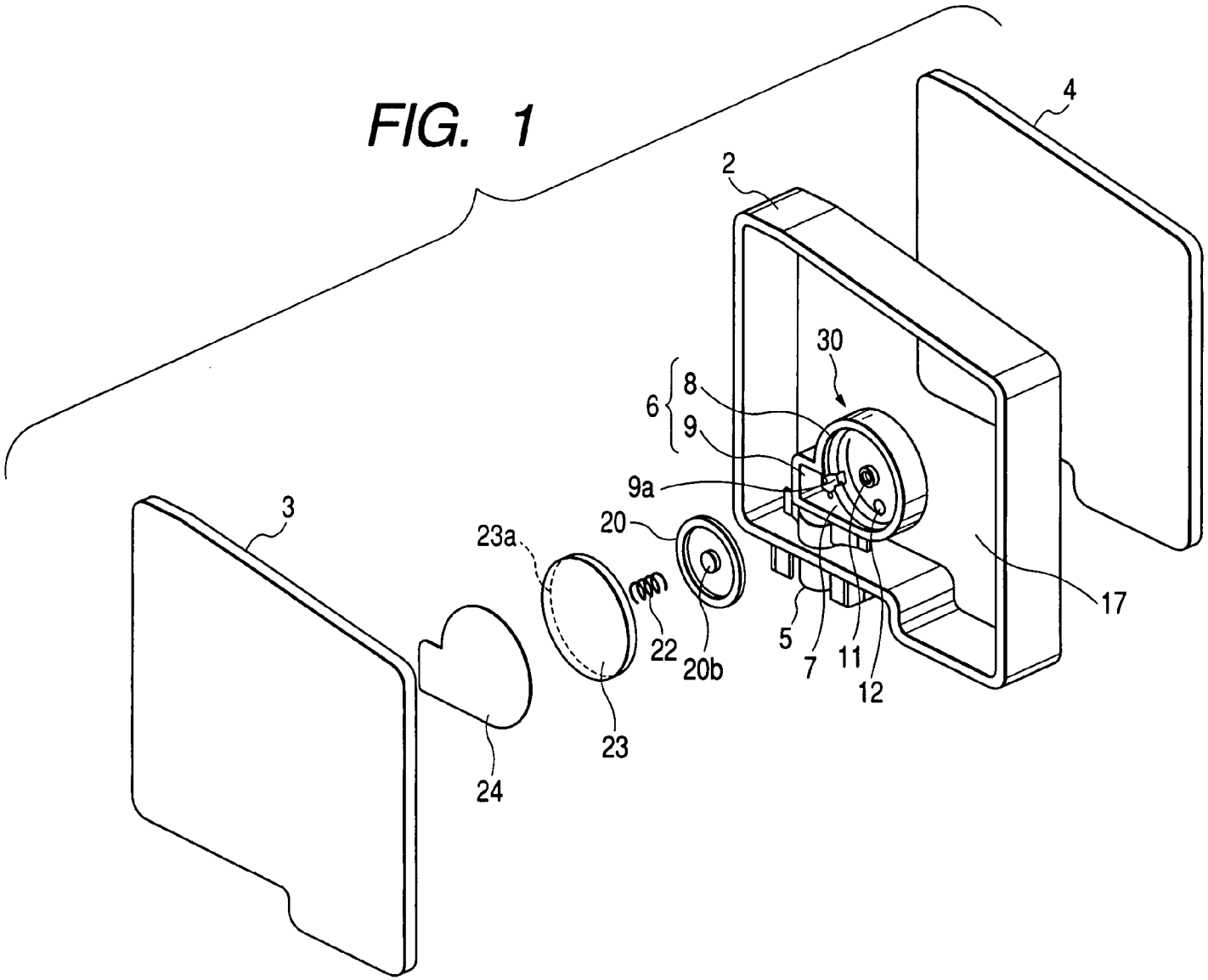
FIG. 1 is an exploded perspective view showing an ink cartridge according to an embodiment of the present invention as viewed from an ink storing chamber side.
Figure 2A:
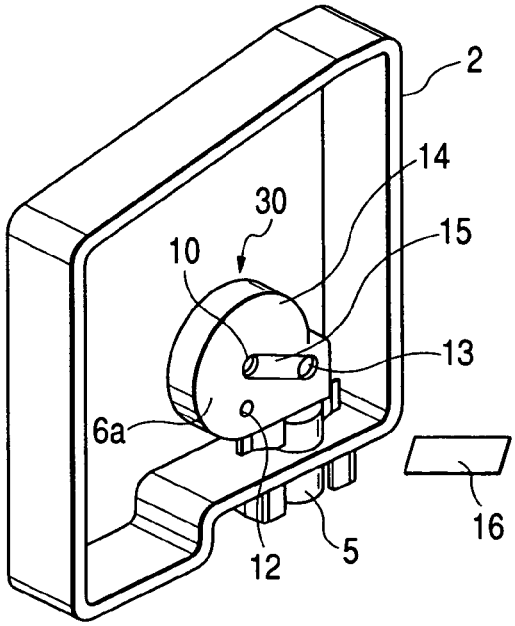
FIG. 2A is a perspective view showing the ink cartridge of FIG. 1 as viewed from the other surface side.
Figure 3:
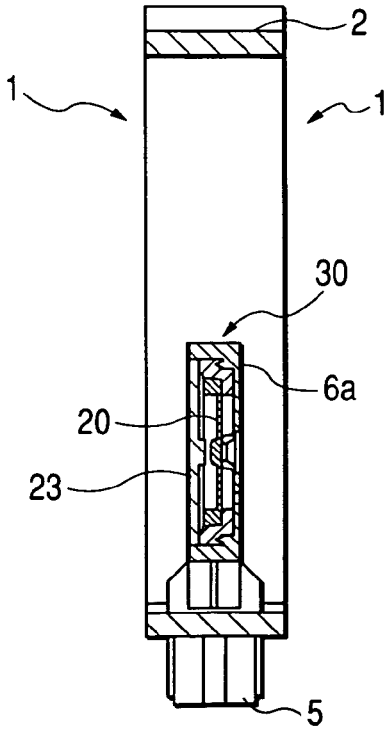
FIG. 3 is a sectional view of the ink cartridge, showing a sectional structure thereof in a vicinity of a negative pressure generating mechanism.

FIG. 1 and FIG. 2A are exploded perspective views showing an assembly of an ink cartridge according to an embodiment of the present invention, depicting the front and rear structures, respectively. FIG. 3 is a view showing a sectional structure thereof. The ink cartridge is in part defined by a frame member 2 having openings 1 on both sides thereof, and lid members 3 and 4 sealing the openings 1, respectively. The ink cartridge is formed with an ink supply port 5 at a leading end side in an insertion direction, e.g. at a bottom surface in this embodiment. The ink supply port according to the present invention encompasses a member or an opening portion to which, or into which, a connection member, such as a hollow needle or pipe, for detachable connection between the ink cartridge and a recording head provided on a carriage, is connectable or insertable.

An ink supply flow passage forming member 6, which is part of a negative pressure generating structure 30 is integrally formed in the vicinity of a portion of the frame member 2 facing the ink supply port 5 so that a portion of the ink supply flow passage forming member 6 located on one opening surface side of the frame member 2 constitutes an opening portion 7. Opening portion 7 is arranged to be in fluid communication with the ink supply port 5.

The ink supply flow passage forming member 6 is substantially divided into a valve member storing portion 8 for storing a substantially circular valve member (called also as an elastic member) 20, and a flow passage portion 9 for fluid communication with the ink supply portion 5. A protruding portion 11 having a first through-hole 10 serving as an ink outflow port is formed at a center of the valve member storing portion 8, and a second through-hole 12 serving as an ink inflow port is formed at a position offset from the protruding portion 11. The flow passage portion 9 is formed with a third through-hole 13 serving as an ink inflow port for communication with a front surface region of the valve member 20.

Figure 4A:
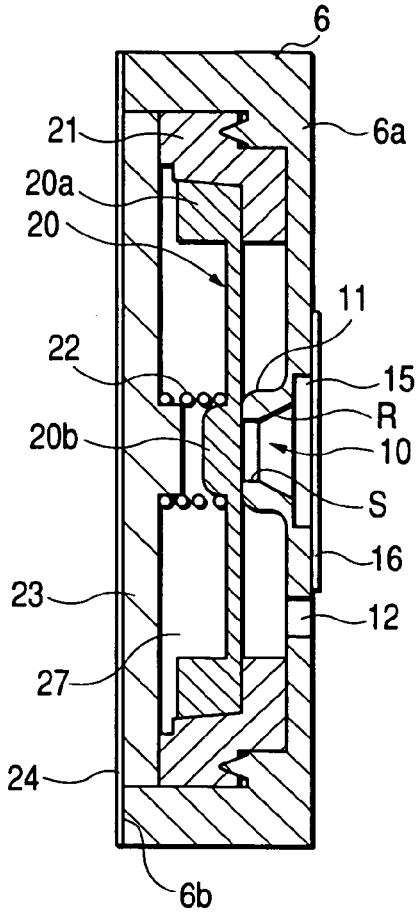
FIGS. 4A and 4B are enlarged sectional views, respectively showing a valve closed state and a valve open state of the negative pressure generating mechanism in the ink cartridge.
Figure 4B:
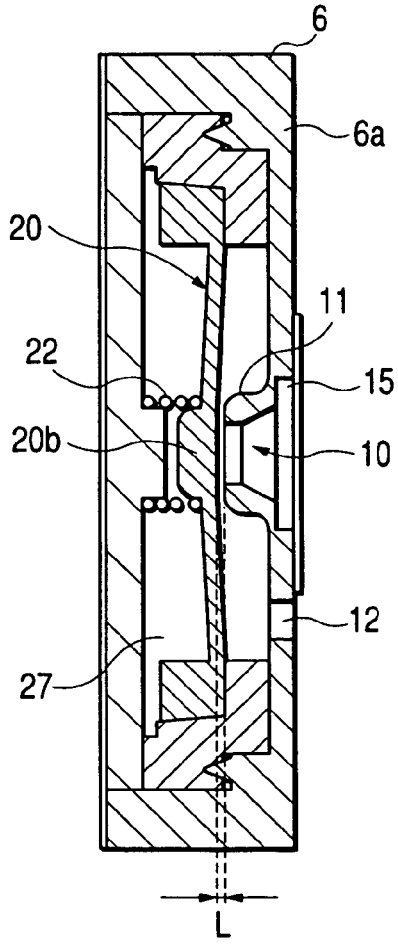
Figure 4C:
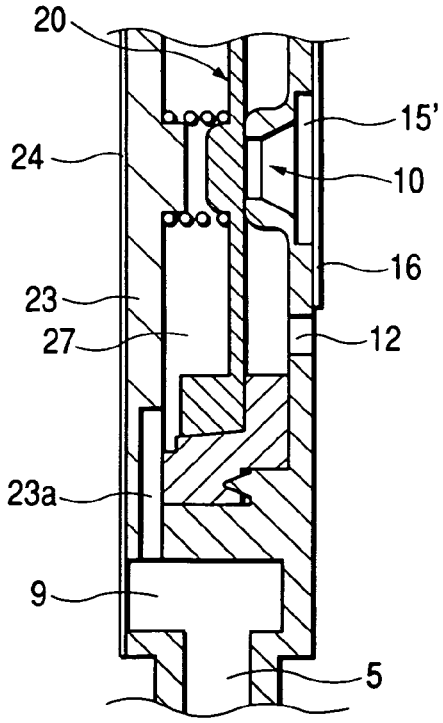
FIG. 4C is a sectional view showing an ink flow passage from the negative pressure generating mechanism to an ink supply port.

As shown in FIGS. 4A-C, the first through-hole 10 is formed to have a substantially cylindrical straight-sided portion S in an elastic member side, and a funnel-shaped portion R that flares outward moving along the through-hole 10 in the direction of ink flow as the ink moves toward the ink supply port 5. This funnel-shaped portion R is continuous to and downstream of the straight portion S. That is, the ink outflow side of the through-hole 10 flares outward. This structure ensures reliable sealing by the straight portion S, and lowers the flow passage resistance to fluid movement in the entire first through-hole 10 by the funnel-shaped portion R.

A recess portion 15 is formed in a surface 14 of a wall surface 6*a* defining the ink supply flow passage forming member 6 so as to connect the first through-hole 10 of the protruding portion 11 to the third through-hole 13 of the flow passage portion 9. A communication passage (hereafter, denoted by reference number 15') is defined by sealing the recess portion 15 with a covering film 16.

In the ink supply flow passage forming member 6 thus constructed, the elastically deformable valve member 20 is mounted via a position adjusting frame 21, as shown in FIG. 4. The valve member 20 is provided with a thick portion 20*a* along the circumference thereof, and thick portion 20*a* has a planar surface facing the protruding portion 11. A spring 22 for adjusting a differential pressure is positioned by a protruding portion 20*b* formed in the center of the valve member 20 and contacts the rear surface (back surface) of the valve member 20. Further, a holding member 23 seals the outside of the ink supply flow passage forming member 6 in water-tight fashion from an ink storing region while permitting communication between the flow passage portion 9 and the back surface of the valve member 20. Incidentally, in the depicted structure, the fit between the valve member 20 and the protruding portion 11 can be improved if the mating portions of these elements are made flat, since this will facilitate alignment, and avoid the need to take into account curvature of or irregularities in the abutting surfaces.

To this end, in order to allow for such communication between the flow passage portion 9 and the back surface of the valve member 20, at least one, and possibly both, of recess portions 9*a* and 23*a* are formed in a region of the ink supply flow passage forming member 6 and the holding member 23 so as to face the flow passage portion 9.

The valve member 20 is preferably made of polymer material, such as an elastomer, which can be formed by injection molding, and which has elastic properties. The valve member 20 is provided with the spring-receiving protruding portion 20*b* at a region facing the protruding portion 11, i.e. at a central portion thereof.

A film 24 is joined or attached to a partition wall 6*b* which is part of the ink supply flow passage forming member 6 so as to cover the surface of the holding member 23 and seal the valve storing portion 8 and the flow passage portion 9, thereby ensuring reliable sealing and separation from the ink storing region.

Figure 2B:
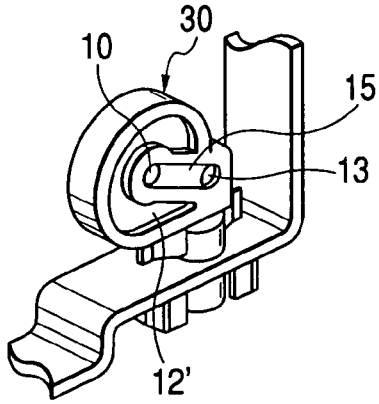
FIG. 2B is a prospective view showing another embodiment of a valve member storing portion.

In the embodiment described above, the second through-hole 12 is formed to be of substantially the same size as the first through-hole 10. However, the present invention is not so limited, and, as shown in FIG. 2B, the second through-hole 12 may be replaced with a window 12' formed as a consequence of removing a greater portion of the wall surface 6*a*, leaving behind enough material to provide a portion that is not deformed due to a pressing force of the spring 22 biasing the valve member 20 and which portion can permit the formation of the recess portion 15 serving as the communication passage. This arrangement thereby provides the same effects as the structure previously described.

In this embodiment, when the ink cartridge is mounted to a recording apparatus, and the pressure of the fluid at the ink supply port 5 side, i.e. the most downstream region from which ink is discharged from the ink cartridge, is reduced through ink consumption by a recording head or the like, the liquid pressure in the flow passage portion 9, the flow passage portion 15' formed by the recess portion 15 and the film 16 and a closed space (called also as a pressure operating compartment) 27 behind the valve member 20 communicating therewith only via a flow passage formed by the recess portion 23*a* is also lowered, so that the reduced pressure acts on the surface which is also pressed with a biasing force by the spring 22 (the closed space 27 is open for fluid communication only via the passage formed by the recess portion 23*a*.) However, in the case where the negative pressure of the fluid in the ink supply port 5 does not reach a predetermined valve, the valve member 20 maintains a sealed state of the first through-hole 10 as it is subjected to the biasing force of the spring 22. In addition, even through this negative pressure acts also on the first through-hole 10 through the communication passage 15' and so is applied to the front surface side of the valve member 20, the area of the through-hole 10 is extremely small, so that the force acting on the front surface side of the valve member is negligible in comparison with the force applied to the back surface side of that valve member.

Figure 5A:
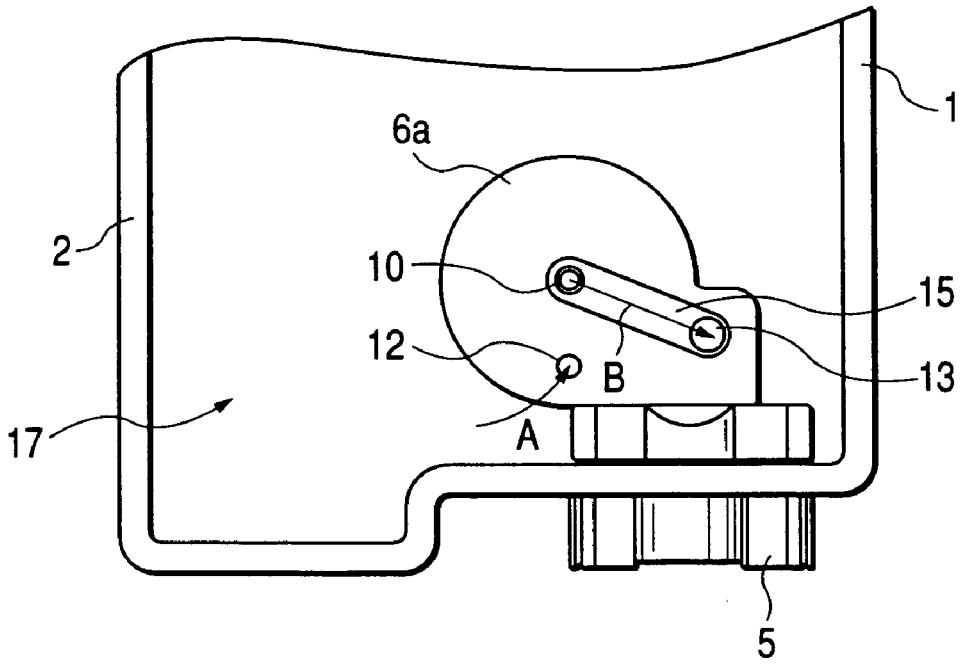
FIGS. 5A and 5B show the flow of ink in the ink cartridge.
Figure 5B:
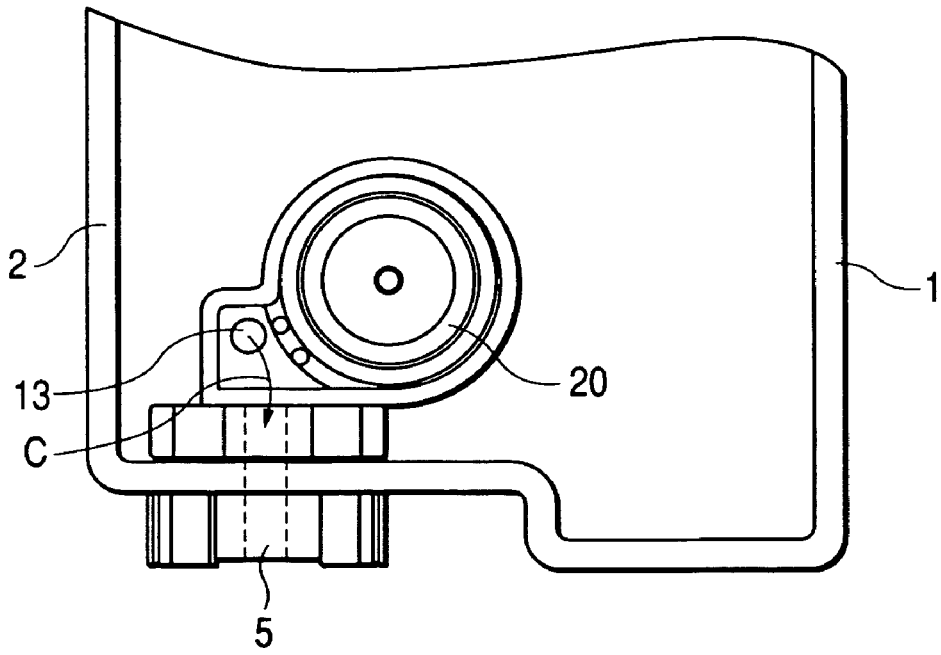

FIG. 4C is a sectional view taken, in part, through the flow passage portion 9 of the negative pressure generating structure 30. When the negative pressure is decreased so that the correspondingly-generated force is less than the force applied by the spring 22 and the inherent rigidity of the valve member 20, the negative pressure at the ink supply port 5 acts on the pressure operating compartment 27 of the valve member 20, which is in communication with the ink supply port through the recess portion 23*a* or 9*a* (FIG. 4C). Accordingly, the valve member 20 experiences a sufficient force from the pressure differential to be moved against the biasing force of the spring 22, and so is separated from the protruding portion 11 (FIG. 4B), allowing ink in the ink storing chamber 17 to flow into the communication passage 15' via the second through-hole 12 (this is depicted by arrow A in FIG. 5A) and the first through-hole 10 of the protruding portion 11. The ink flowing into the communication passage 15' flows via the third through-hole 13 (depicted by arrow B in FIG. 5A) and the flow passage portion 9 into the ink supply port 5 (depicted by arrow C in FIG. 5B).

When a predetermined quantity of ink flows into the ink supply port 5 in this fashion to increase the pressure at the back surface of the valve member 20, the change in the pressure differential across the valve member 20 causes the valve member 20 to be elastically contacted with the protruding portion 11 under the biasing force of the spring 22, and so seal the through-hole 10 (FIG. 4A).

Thereafter, this operation is repeated to supply ink into the recording head, while maintaining the pressure at the ink supply port side at the predetermined negative pressure.

It should be noted that this regulation of the ink flow takes place automatically in response to the consumption of ink from the ink supply port. This avoids the need to have a dedicated external control system which periodically opens and closes the valve to regulate ink flow from the ink container to the ink supply port, and so simplifies and improves the ink cartridge construction.

Figure 6A:
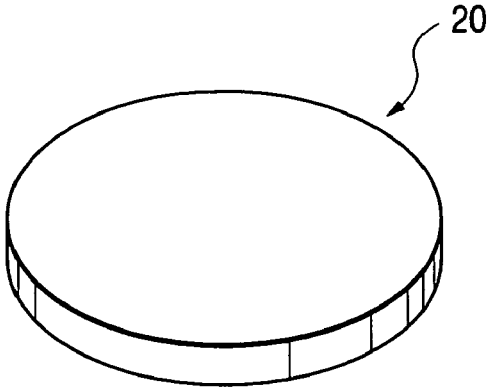
FIGS. 6A and 6B are views showing different embodiments of a valve member.
Figure 7:
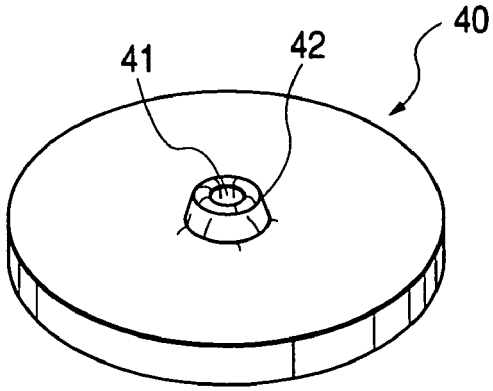
FIG. 7 is a perspective view showing a valve member used in a conventional ink cartridge.

As shown in FIG. 6A, the sealing side of the valve member according to the present invention is formed as the planar surface. This is in contrast to a conventional valve member 40 as shown in FIG. 7, and in the present invention there is no protruding portion 42 having a through-hole 41 in the region that contacts a valve seat. By virtue of this structure, the valve member according to the present invention is free from welds, i.e. grooves (slits shown in FIG. 7) which are likely to occur during the injection molding, and therefore this invention can increase the manufacturing yield of acceptable valve members.

Further, since the region of the valve member 20 that contacts the protruded portion 111 can be formed to be as wide a planar surface as possible, precise alignment of a small flat region with the protruded portion is not a concern, and so the large flat region can be reliably and closely contacted with the protruding portion 11 serving as a valve seat, to thereby provide a high sealing force.

Figure 8A:
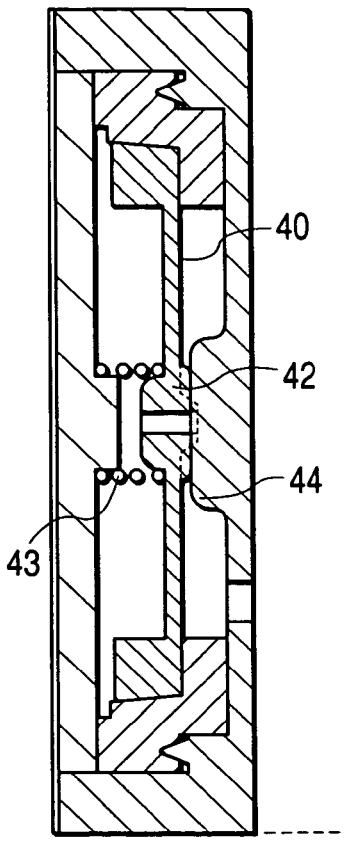
FIGS. 8A and 8B are enlarged views showing a valve closed state and a valve open state of the conventional ink cartridge, respectively.
Figure 8B:
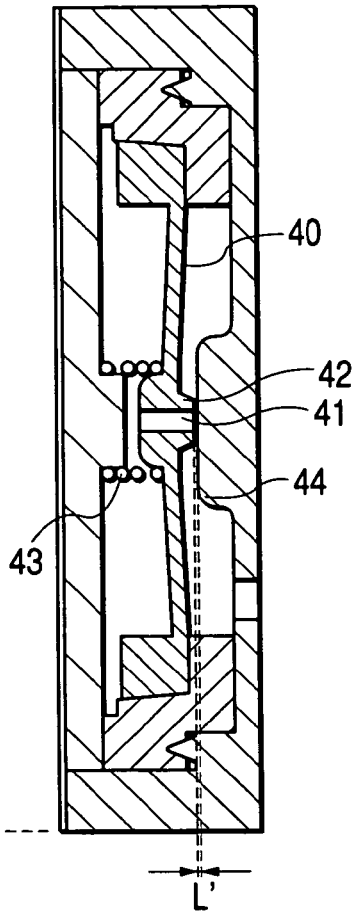
Figure 8C:
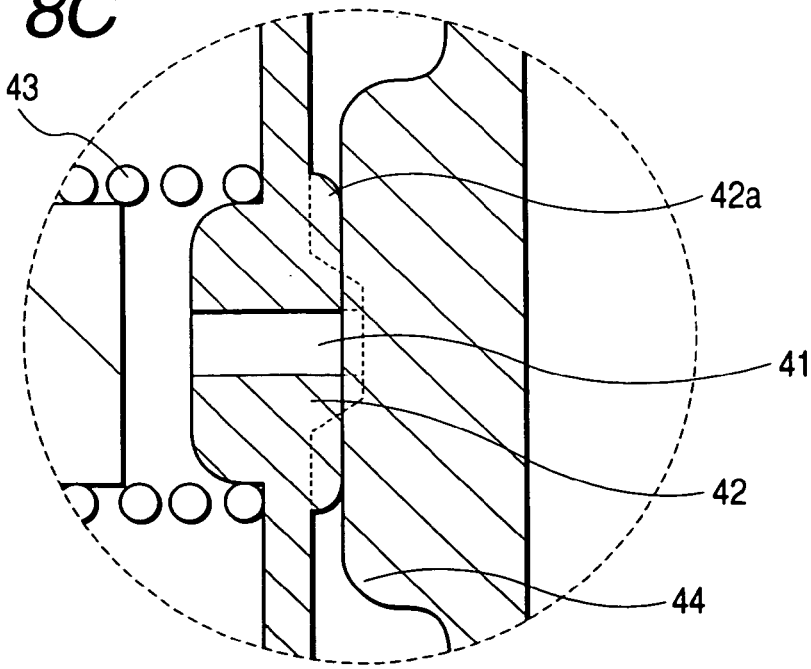
FIG. 8C is an enlarged view showing a shape of a protruding portion in the valve closed state.

In contrast, as shown in FIGS. 8A and 8B, a conventional valve member 40 establishes a state in which the protruding portion 42 is forced against a sealing member 44 under the elastic force of the spring 43, and as a consequence, is collapsed and deformed elastically.

On the other hand, since the negative pressure acting on the valve member 40 when the valve member 40 is opened remains constant, even when it is separated from the sealing member 44, the region 42*a* which has been elastically deformed is restored to the original state to make a flow passage clearance L' extremely small, resulting in the problem of a large flow passage resistance.

Moreover, in view of the fact that the through-hole 41 is formed through the valve member 40 made of elastically deformable material, it is necessary to make the area of the sealing member 44 large in order to accommodate a positional shift of the through-hole 41 due to deflection of the valve member 40 or the like. This causes a further problem in that there is increased flow resistance because the narrow clearance region in the vicinity of the through-hole 41 is inevitably long.

In contrast, according to the present invention, since the sealing side of the valve member 20 is formed as the planar surface, no such restoration is caused even if the valve member 20 is returned to the original posture by the action of the negative pressure, and so a large clearance L can be maintained. Further, since the first through-hole 10, which forms the ink flow passage during the valve open state, can be formed through the valve member storing portion, which is preferably made of a material more rigid than the valve member, the protruding portion 11 can be formed to be as small as possible while still ensuring a large flow passage between the valve member 20 and the end face of the through-hole 10 because of its rigidity. Accordingly, it is possible to reduce the flow resistance in the vicinity of the through-hole 10.

Figure 6B:
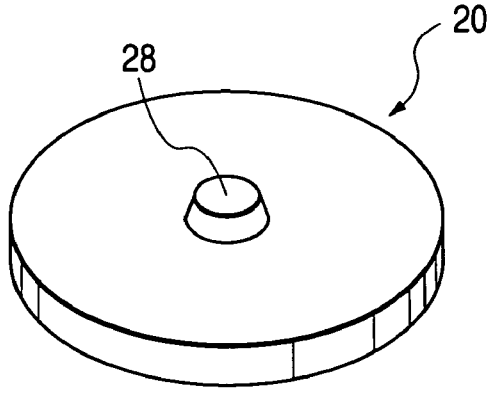

In the embodiment described above, the surface to be contacted with the valve seat is formed as the planar surface. Alternatively, as shown in FIG. 6B, a protruding portion 28 may be formed with a configuration which does not generate welds, and which still provides the same beneficial effects as already discussed in connection with the planar surface. In this case, the protruding portion 28 may be dimensioned and tapered so as to enter into the through-hole 10 of the protruding portion 11 when the two components are urged together.

In the embodiment described above, the valve member and the frame member are constructed as discrete members. However, they may be formed as a one-piece member through coinjection molding with respective appropriate materials.

Figure 9:
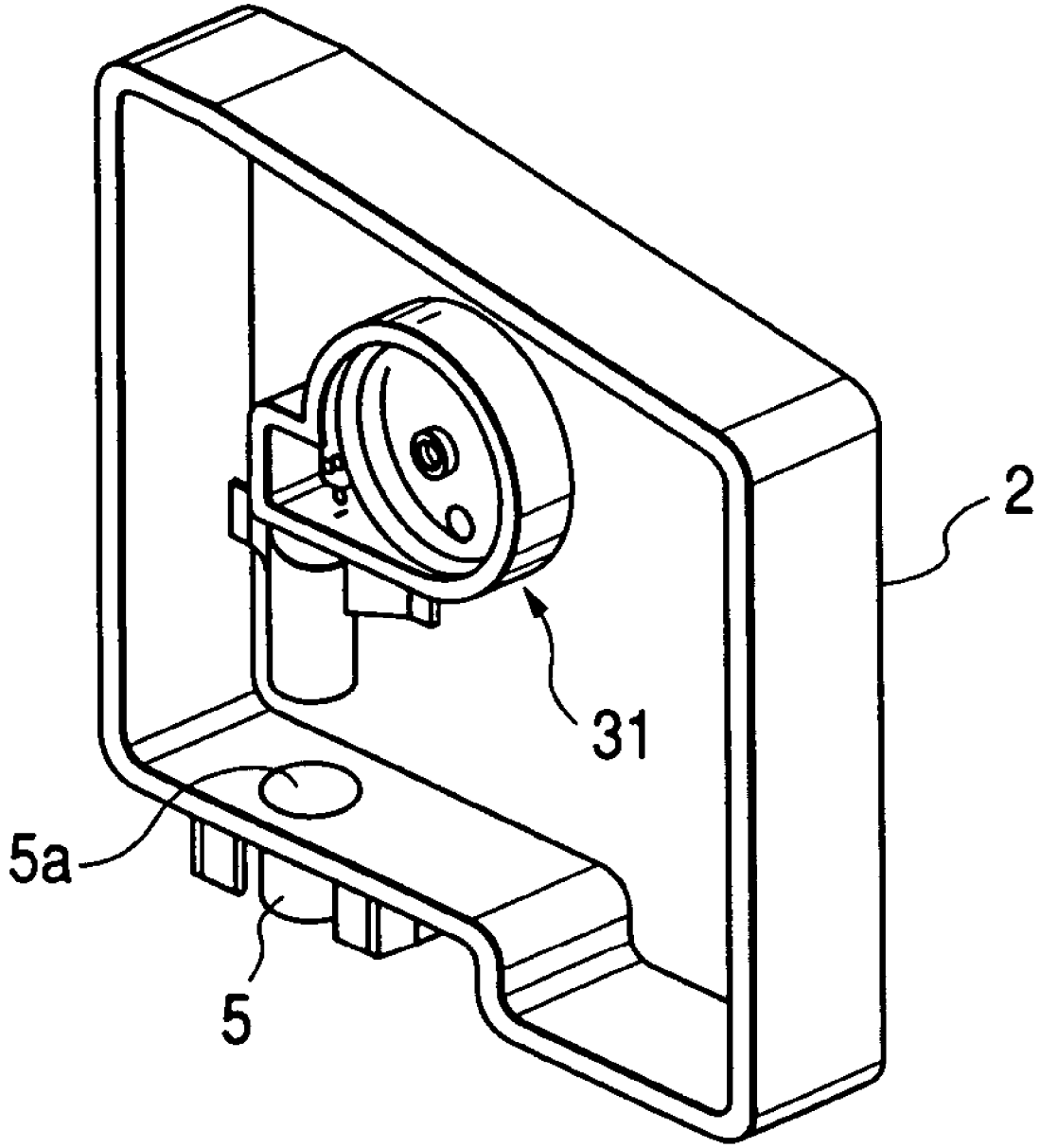
FIG. 9 shows another embodiment in which a member defining a region where the negative pressure generating mechanism is installed is formed as a discrete member.

In the embodiment described above, the wall defining the region where the negative pressure generating mechanism is installed is formed to be integral with the member defining the ink storing region. Alternatively, as shown in FIG. 9, the member defining the region where the negative pressure generating mechanism is installed may be constructed as a discrete member 31, which is inserted into an upstream side opening 5*a* of the ink supply port 5.

Next, another embodiment of the present invention will be discussed.

Figure 10:
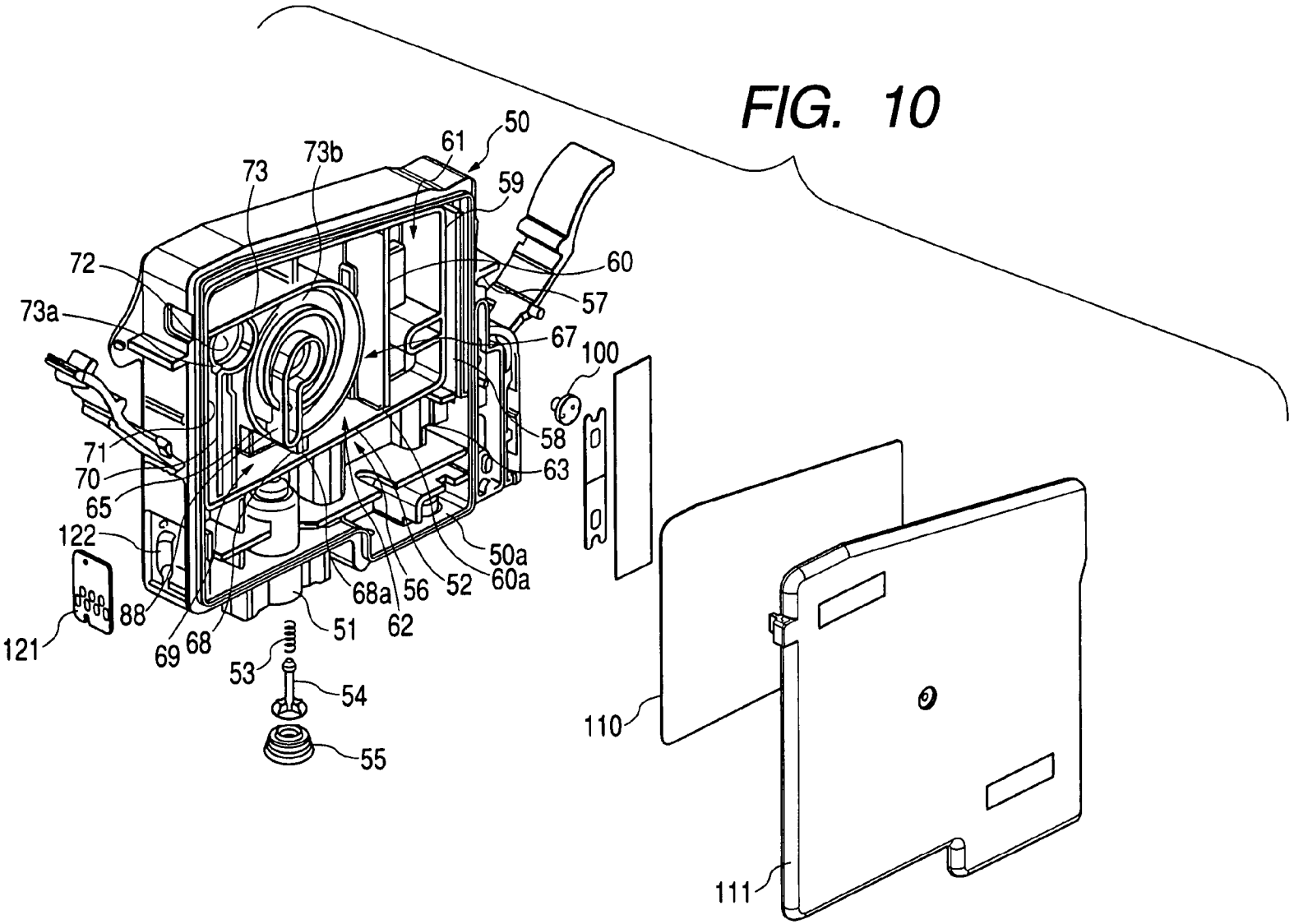
FIG. 10 is a perspective view showing the assembly of an ink cartridge according to another embodiment of the present invention, and in particular showing a structure of an opening side of a container main body.
Figure 14:
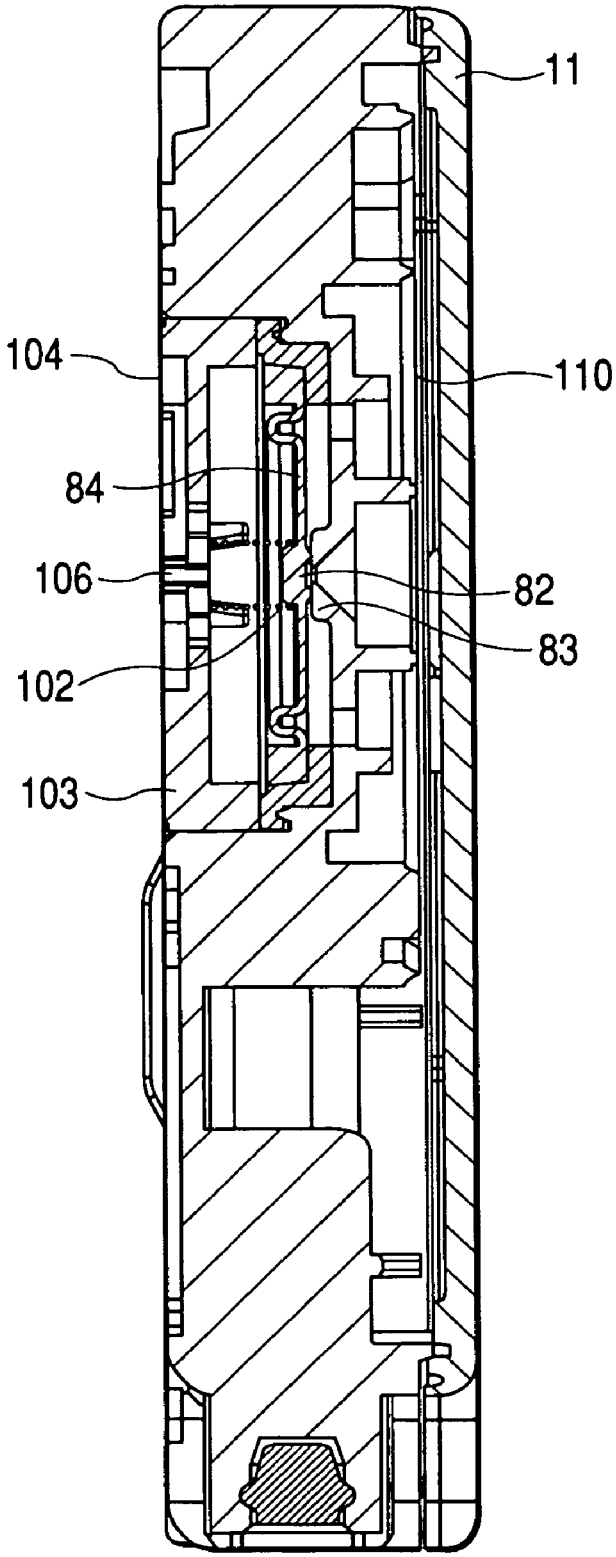
FIG. 14 is a sectional view showing a region of the container main body, where a negative pressure generating mechanism is assembled.
Figure 15:
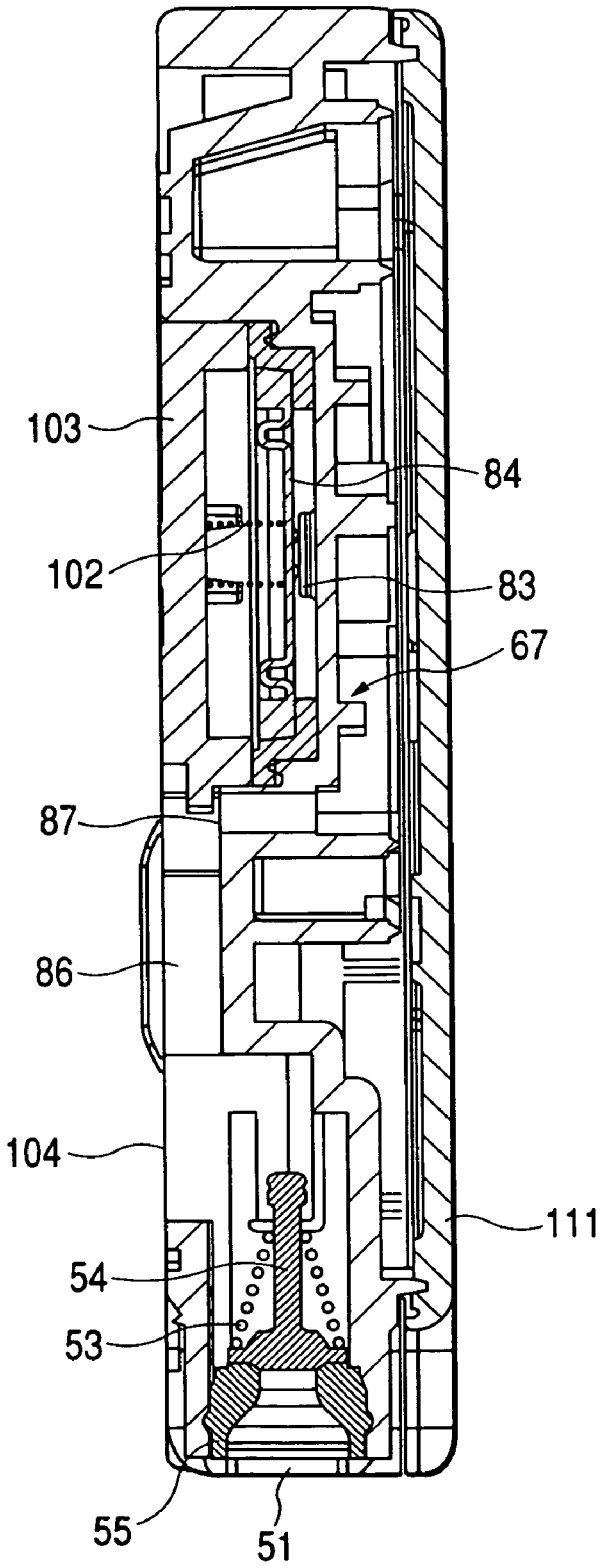
FIG. 15 is a sectional view showing a flow passage part of the container main body from the region, into which the negative pressure generating mechanism is assembled, to an ink supply port.
Figure 16:
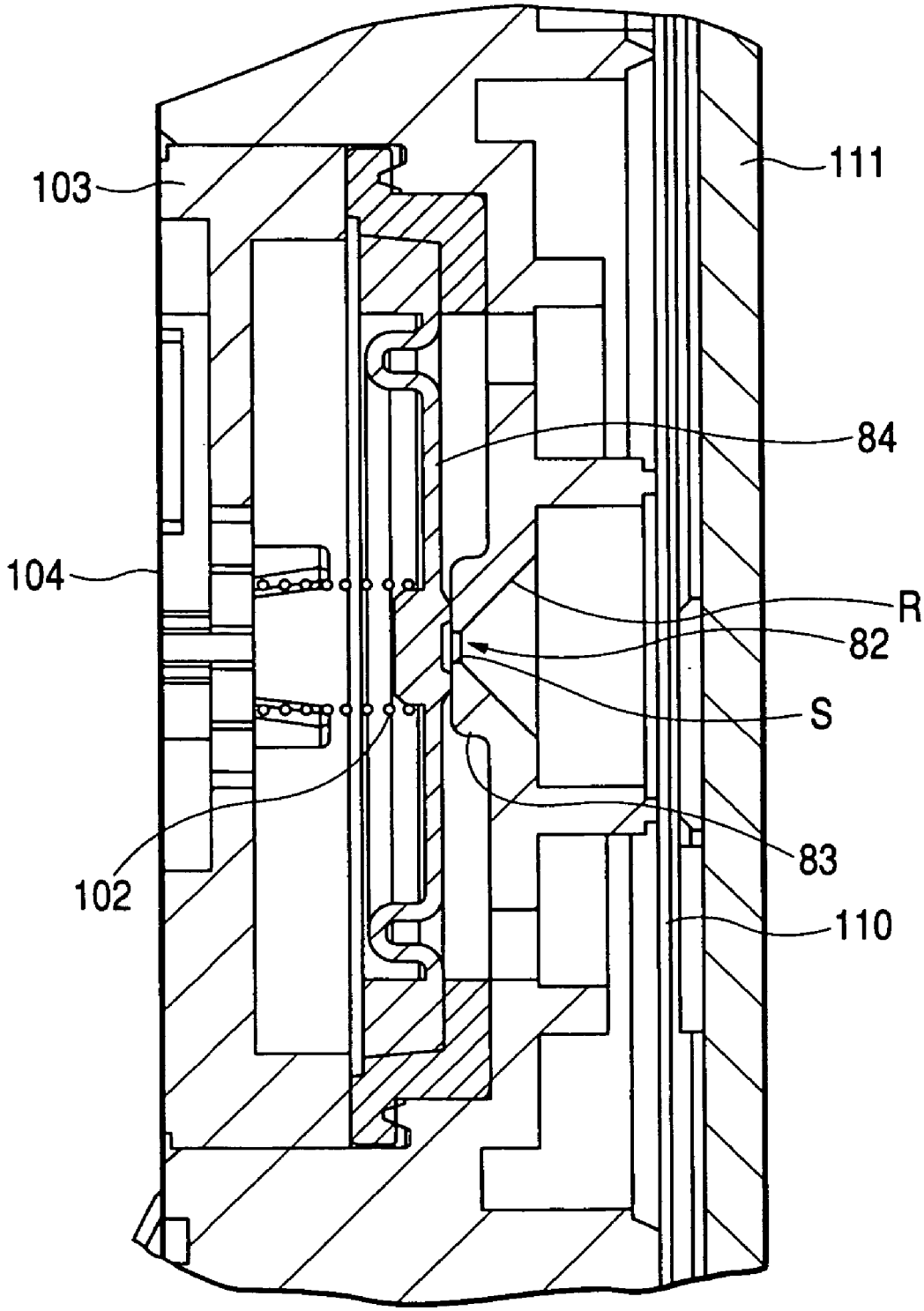
FIG. 16 is an enlarged sectional view showing the region into which the negative pressure generating mechanism is assembled.

FIGS. 10 to 13 show the front and rear structures of an ink cartridge with an opening closure member removed. FIGS. 14 to 16 show details of a negative pressure generating mechanism that is seen in cross-section. With reference now to FIG. 10, the interior of a container main body 50 forming an ink storage region is vertically divided by a wall 52 extending substantially in a horizontal direction, and, more specifically, extending so that an ink supply port 51 side of the wall 52 is located slightly downward. A valve member 54, a fixing member 55 and a spring 53 are stored in the ink supply port 51, so that in the state where the ink cartridge is not mounted upon a recording apparatus main body, the valve member 54 is kept in elastic contact with the fixing member 55 by the spring 53 to sealingly close the ink supply port 51.

The lower region below the wall 52 is formed with a first ink storage chamber 56, and the upper region above the wall 52 is defined by a frame 59 having the wall 52 as a bottom surface, and that is separated from a wall 57 of the container main body 50 by a clearance, preferably constant, to form an atmosphere communication passage 58. The interior region of the frame 59 is further divided by a vertical wall 60 formed at its bottom with a communication port 60*a*, so that one of the divided regions (i.e. a right side region in the drawing) serves as a second ink storage chamber 61, and the other region serves as the third ink storage chamber 62.

A suction flow passage 63 is formed in a region opposing the first ink storage chamber 56 so as to connect the second ink storage chamber 61 and a bottom surface 50*a* of the container main body 50. The suction flow passage 63 is constructed by forming a recessed portion 64 (FIG. 11) in the front surface of the container main body 50 and sealing this recessed portion 64 with an air impermeable film 104, to be described later in greater detail.

In the third ink storage chamber 62, an ink supply flow passage forming member 67 is constructed by forming an annular frame wall 65 flush with the frame 59, and a planar surface 66 dividing the interior of the annular frame wall into front and rear sides. A vertical wall 68 is formed between the lower portion of the frame wall 65 and the wall 52 to define a fourth ink storage chamber 69. A recessed portion 68*a* for communication is formed in the lower portion of the wall 68.

A partition wall 70 is provided between the fourth ink storage chamber 69 and the frame portion 59 to form an ink flow passage 71. The upper portion of the ink flow passage 71 communicates with the front surface side of the container main body 50 via a through-hole 72 that can serves as a filter chamber, if desired.

The through-hole 72 is defined by a wall 73 continuous with the wall 70 such that the through-hole 72 communicates with the upper end of the ink flow passage 71 via a recessed portion 73*a*. The through-hole 72 also communicates via a preferably tear-drop-shaped recessed portion 74 formed in the front surface side, and a communication port 73*b* with the interior of the frame wall 65.

Figure 11:
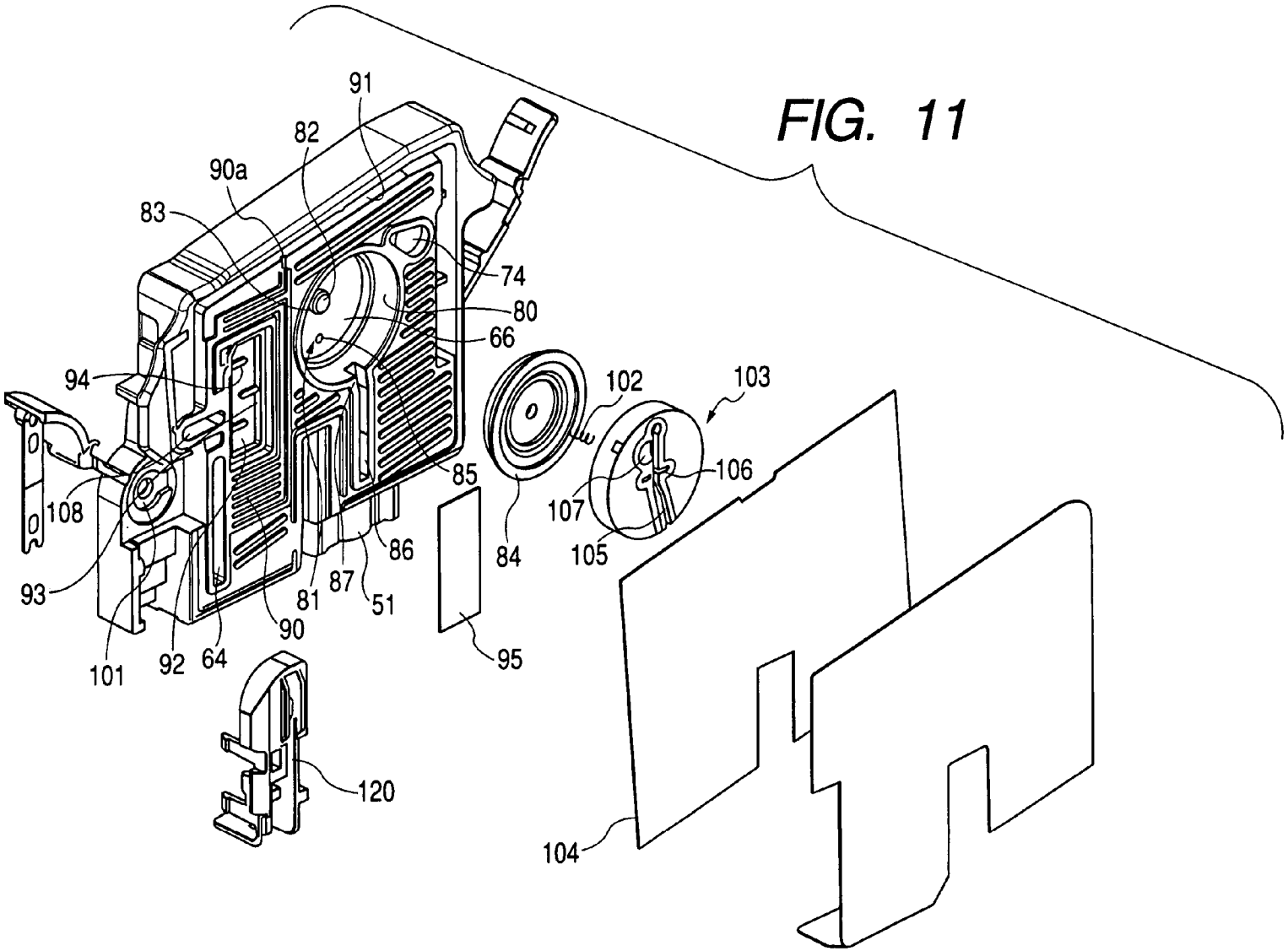
FIG. 11 is a perspective view showing the assembly of the ink cartridge, particularly showing a structure of a front surface side thereof.

As shown in FIG. 11, the lower portion of the ink supply flow passage forming member 67 is connected to the ink supply port 51 via a flow passage constructed from a recessed portion 86 formed in the surface of the container main body 50 and an air impermeable film 104 sealing this recessed portion 86. The ink supply flow passage forming member 67 has the planar surface 66 and an annular wall 80 that are located in the front surface side of the container main body 50 and that are opposite from the ink storage region, to thereby define a valve member storage portion 81. The planar surface 66 is formed to have at its approximate center a protruding portion 83 having a through-hole 82. The planar surface 66 is also formed, at offset positions from the protruding portion 83, with a communication passage 85 communicating with the front surface of the valve member 84. The through-hole 82, in a manner similar to that shown in FIG. 4A, is constructed by a substantially cylindrical straight portion S located on the elastic member side, and a funnel-shaped portion R that is gradually enlarged in the direction of ink flow toward the ink supply port 51 and which is continuous to and downstream of the straight portion S (that is, the ink outflow side of the through-hole 82 flares outward), whereby a reliable seal is ensured by the straight portion S, while the flow passage resistance in the entire through-hole 82 is reduced by the funnel-shaped portion R.

A notched portion 87 is formed in the vicinity of the lower end of the wall 80, which is connected to the recessed portion 86 extending downwardly toward the ink supply port 51. The depth of this notched portion 87 is chosen so that the notched portion 87 communicates only with a back surface side of the valve member 84 when the valve member 84 is installed. A wall 88 is formed in the rear surface side opposing the through-hole 82, i.e. in the upper ink storage region, and this wall which extends toward the upper end of the recessed portion 86 while escaping from the communication passage 85 and also partitions a space from the surrounding region, so that the space is connected via through-hole 89 at a lower end of the wall 88 to the upper end region of the recessed portion 86.

The front surface of the container main body 50 is formed with a narrow groove 90 that meanders to increase the flow passage resistance as much as possible, a wide groove 91 around the narrow groove 90, and a rectangular recessed portion 92 located in a region opposing the second ink storage chamber 61. A frame portion 93 is formed in the rectangular recessed portion 92 at a location slightly lower than an opening edge of the recessed portion 92, and ribs 94 are formed inside the frame portion 93 to be separated one from another. An ink-repellent air permeable film 95 is stretched over and adhered to the frame portion 93 to define an atmosphere communication chamber.

Figure 12:
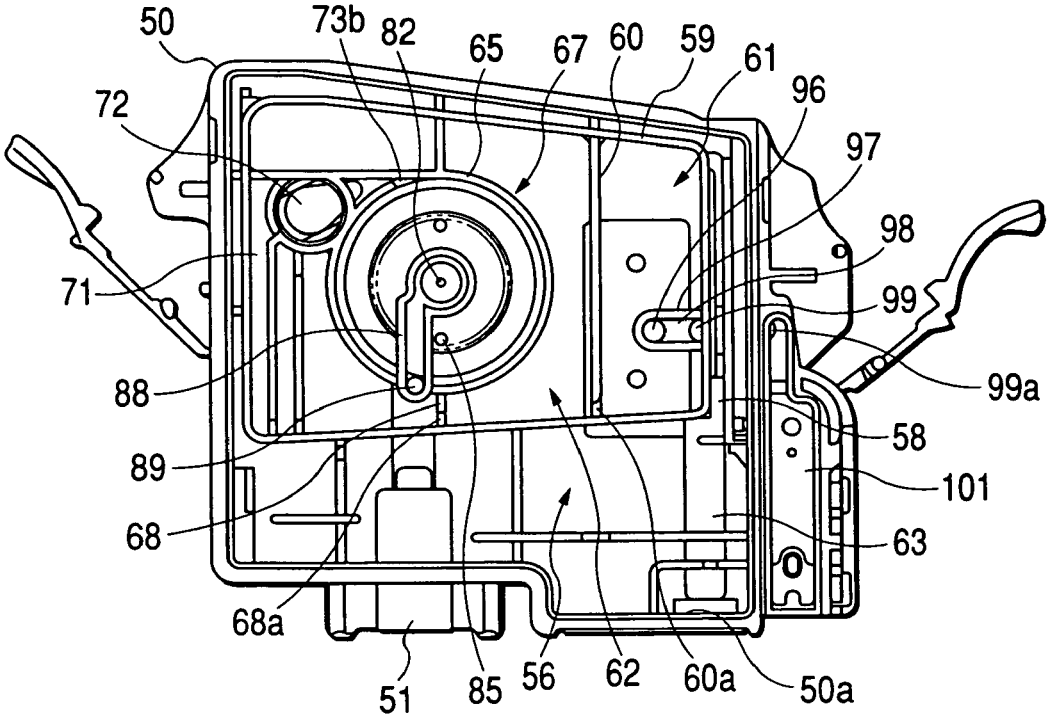
FIG. 12 is a front view showing the opening side of the container main body.
Figure 13:
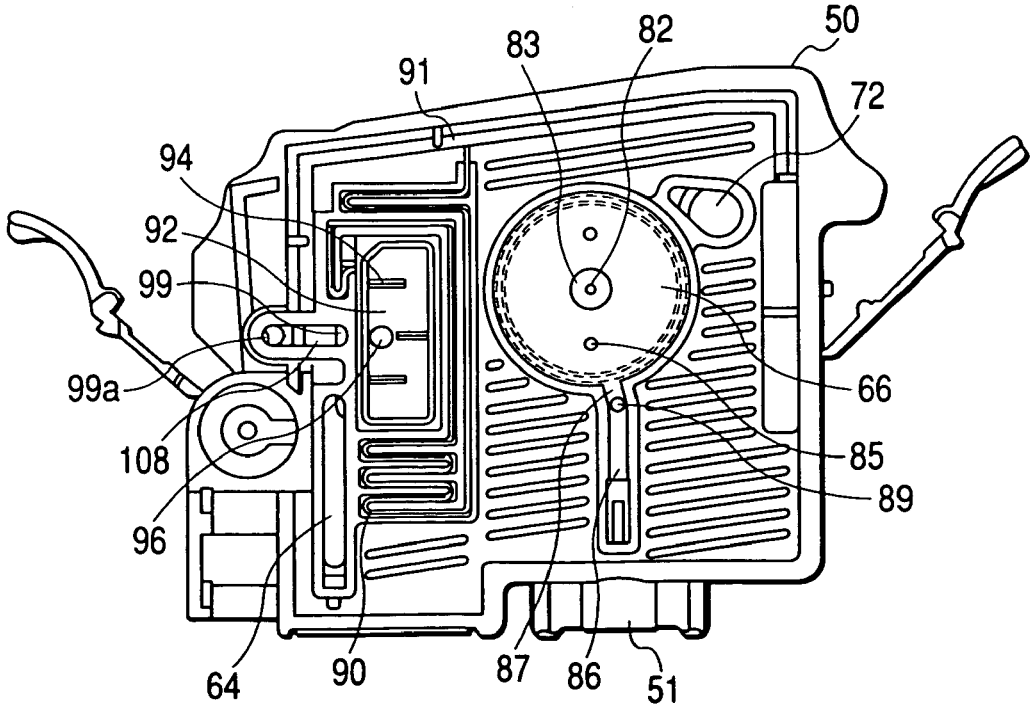
FIG. 13 is a front view showing a bottom portion side of the container main body.

As seen in FIGS. 12 and 13, a through-hole 96 is formed in the bottom surface of the recessed portion 92 to communicate with a slender region 98 partitioned by a wall 97 formed in the interior of the second ink storage chamber 61. The other end of the region 98 communicates via a through-hole 99 formed in the region 98, a groove 108 formed in the front surface of the container main body 50, and a through-hole 99*a* with a valve storage chamber 101 containing therein an atmosphere communication valve 100 that opens when the ink cartridge is mounted on a recording apparatus. The surface side region of the recessed portion 92 with respect to the air permeable film 95 communicates with one end 90*a* of the narrow groove 90.

The valve storage portion 81 of the container main body 50 is constructed in a manner similar to that for the aforementioned embodiment discussed in connection with FIG. 1. As shown in FIG. 11, the valve member 84 and the spring 102 are installed in like fashion, the holding member 103 is mounted in the same manner, and the film 104 is attached to cover the front surface of the container main body 50 in the same way. The holding member 103 is formed with a groove 105 communicating with the notched portion 87, and flow passages 106 and 107 communicating with the back surface of the valve member 84.

Consequently, the recessed portions 74, 86 and 105 together with the film 104 form the ink flow passage, and the narrow grooves 90 and 91 and the recessed portion 92 and 108 together with the film form the capillary and the atmosphere communication passage.

At the opening side of the container main body 50, openings of the upper portion ink storage chambers 61, 67 and 69 and the opening of the ink supply flow passage forming member 67 are sealed by a film 110 to separate these regions from the lower portion ink storage chamber 56 and the atmosphere communication passage 58. Thereafter, the lid member 111 is sealingly attached to the container main body 50 to complete the lower portion ink storage chamber 56.

In addition, as shown in FIGS. 10 and 11, reference numeral 120 in the drawings designates an identification piece that is used to prevent erroneous mounting of the ink cartridge, and reference numeral 121 designates a memory device that stores ink information, etc. therein, and which is mounted in a recessed portion 122 of the container main body.

When the ink cartridge thus constructed is mounted on an ink supply needle communicating with a recording head, the valve member 54 is moved backward by the ink supply needle against the biasing force exerted by the spring 53, to thereby open the ink supply port 51. In this state, as the pressure in the ink supply port 51 is lowered as a consequence of ink consumption by the recording head as it effects recording, etc., the reduced pressure acts on the flow passage formed by the recessed portion 86 and the film 104 and on the back surface of the valve member 84 via the notched portion 87, i.e. on the surface where the valve member 84 receives the pressing force of the spring 102. If the pressure in the ink supply port 51 is not reduced to less than a predetermined value sufficient to move the valve member 84, the valve member 84 remains pressed in elastic contact against the protruding portion 83 by the biasing force exerted by the spring 102 to thereby keep closed the through-hole 82. Therefore, ink does not flow from the ink storage chamber to the ink supply port 51.

When the pressure in the ink supply port 51 (i.e. in a flow passage of the member or opening portion to which or into which the connection member, such as the hollow needle or pipe, for detachable connection between the ink cartridge and the recording head provided on the carriage is connected or inserted) is reduced to the predetermined value as a consequence of continued ink consumption by the recording head, the pressure acting on the back surface of the valve member 84 via the flow passage as described above becomes sufficient to overcome the force exerted by spring 102, and therefore the valve member 84 is separated from the protruding portion 83. Consequently, ink flows from the communication passages 85 into a region between the valve member 84 and the planar surface 66 so that the ink flows from the through-hole 82 via the passage formed by the recessed portion 88 and the film 110, the through-hole 89, the flow passage formed between the recessed portion 86 and the film 104, and the ink supply port 51 into the recording head of the recording apparatus.

When the pressure on the back surface of the valve member 84 is increased as a result of a predetermined amount of ink flowing into the back surface side of the valve member 84, the valve member 84 is again urged into contact with the protruding portion 83 by the biasing force of the spring 102 to close the through-hole 82, to thereby block the flow passage. Accordingly, it is possible to maintain the liquid in the ink supply port 51 at a negative pressure sufficient to prevent ink leakage from the recording head, while enabling supply of ink to the recording head.

As ink is consumed, the ink in the fourth ink storage chamber 69 flows via the flow passage 71 and the through-hole 72 into the front surface side of the valve member 84. Further, since the only the first ink storage chamber 56 is opened to the atmosphere, ink in the third ink storage chamber 62 flows into the fourth ink storage chamber 69 via the recessed portion 68*a* as the ink in the fourth ink storage chamber 69 is consumed, and ink in the second ink storage chamber 59 flows into the third ink storage chamber 62 via the recessed portion 60*a* as ink in the third ink storage chamber 62 is consumed. Ink in the first ink storage chamber 56 flows into the second ink storage chamber 61 via the suction flow passage 63 as ink in the second ink storage chamber 61 is consumed. Therefore, the most upstream side ink storage chambers are sequentially emptied earlier, so that ink in the first ink storage chamber 56 is consumed first, then ink in the second ink storage chamber 61 is consumed, and so on.

Figure 17:
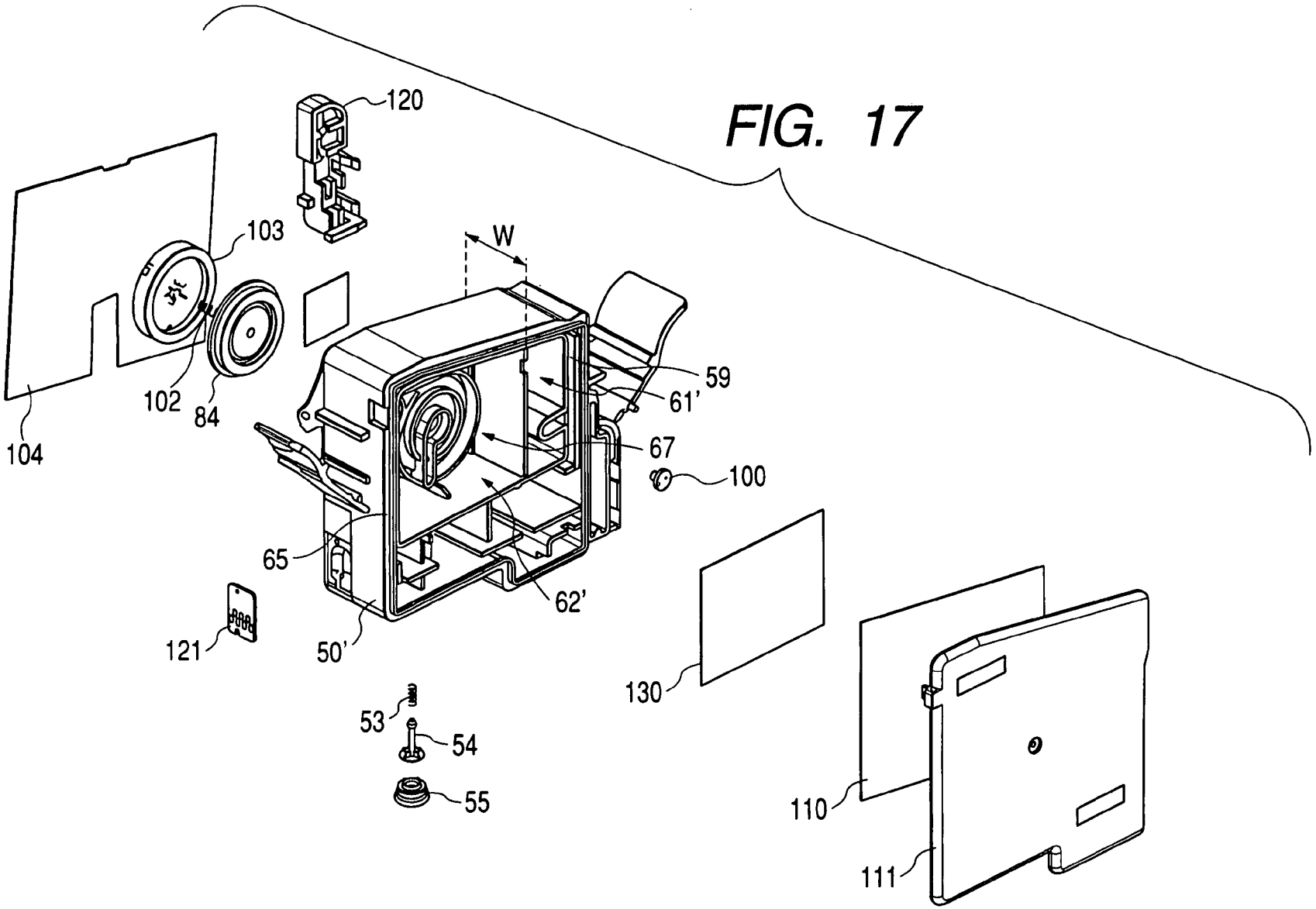
FIG. 17 is an exploded perspective view showing the assembly of an ink cartridge according to another embodiment of the present invention, particularly showing an opening side of a container main body.

FIG. 17 shows another embodiment in which the ink capacity of the aforementioned ink cartridge is increased. The container main body 50' of this embodiment has the same structure as the container main body 50 of the aforementioned embodiment with the exception that the width W of the container main body 50' is made larger.

As a consequence of this modification, since the height of the partition wall 65 of the ink supply flow passage forming member 67 differs from that of the frame 59', a third film 130 is used to seal the opening portion of the partition wall 65 of the ink supply flow passage forming member 67.

Figure 18:
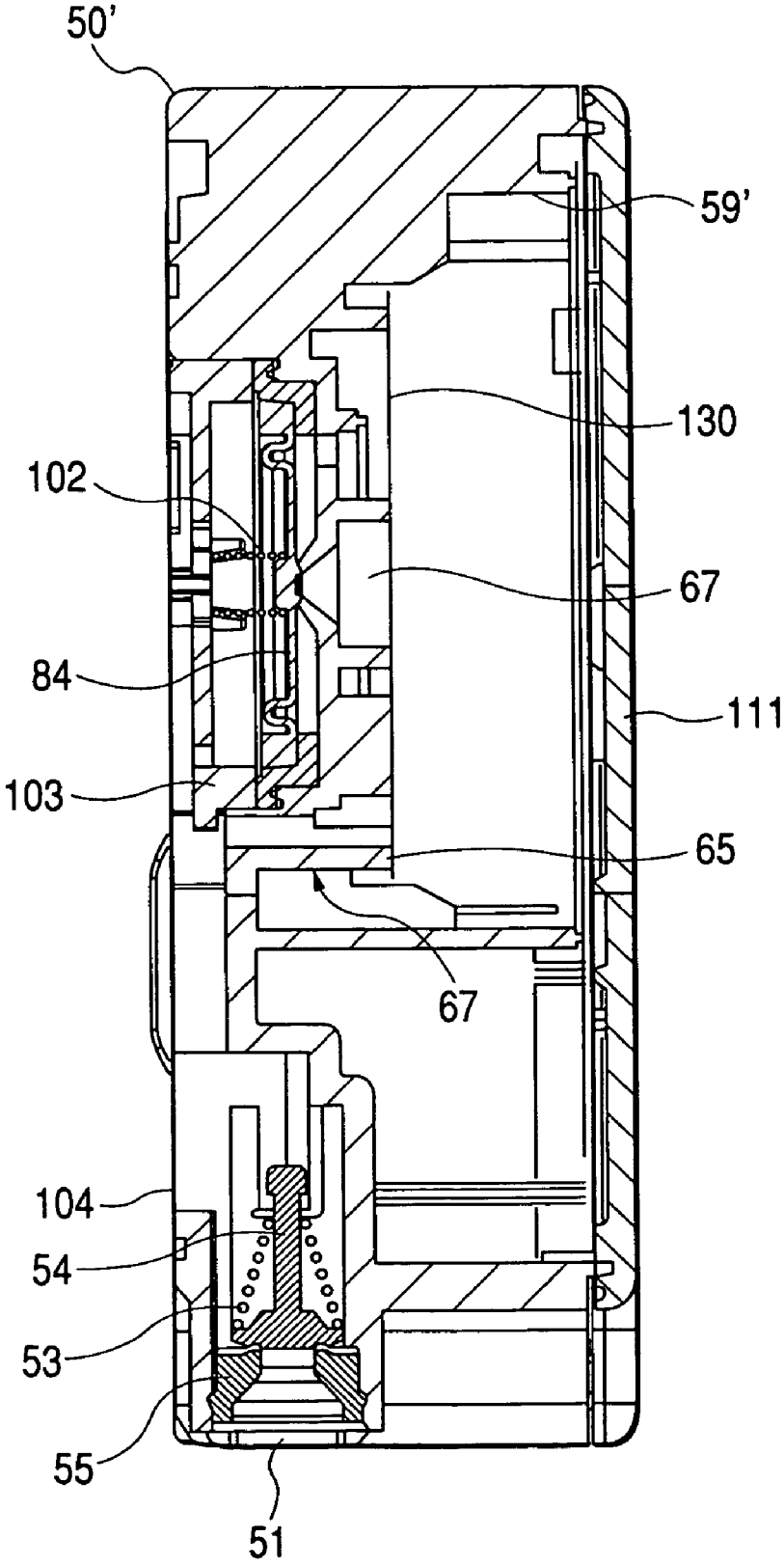
FIG. 18 is a sectional view showing a region of the container main body into which a negative pressure generating mechanism is assembled.
Figure 19:
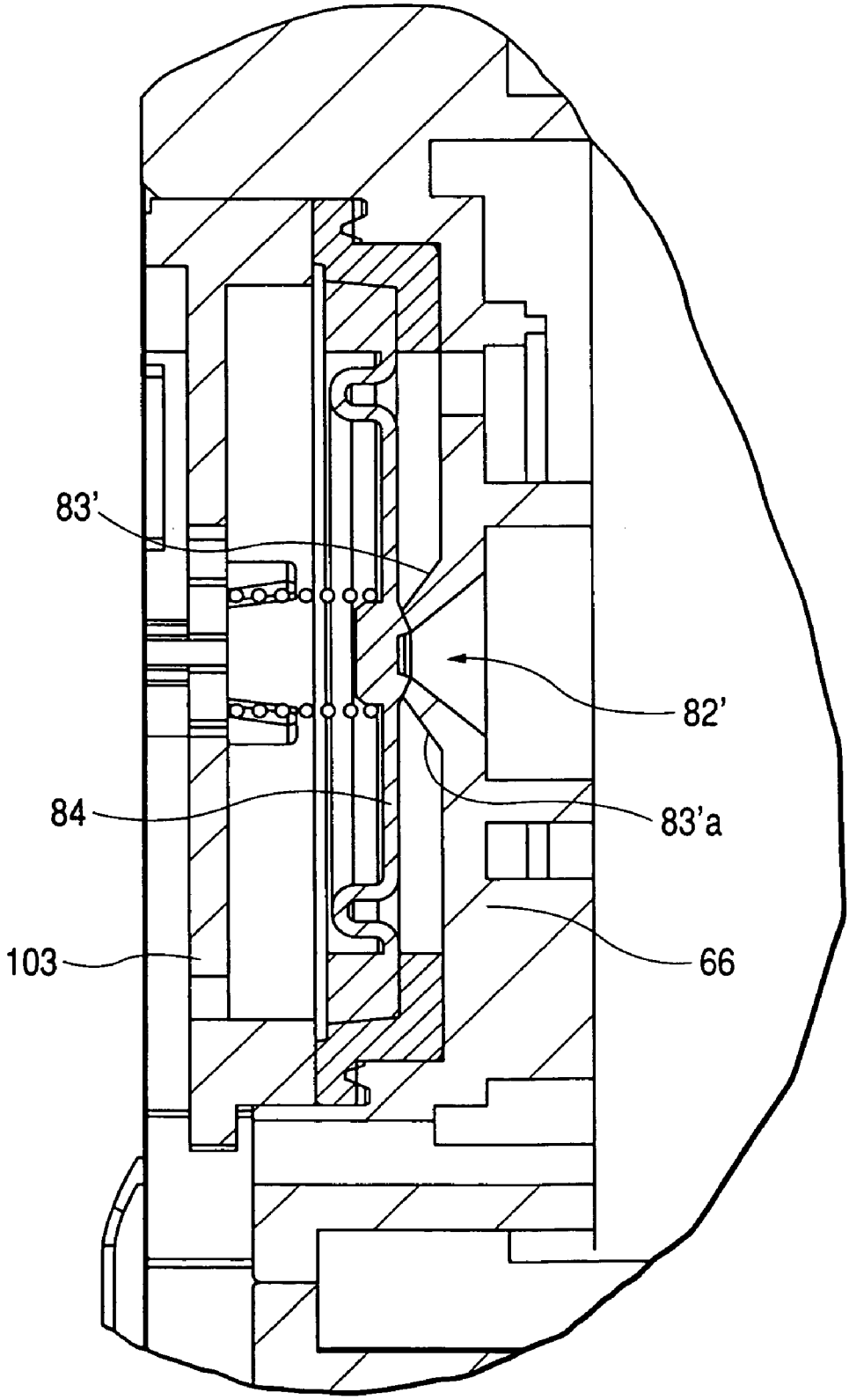
FIG. 19 is an enlarged sectional view showing the region into which the negative pressure generating mechanism is assembled.

In the embodiment shown in FIGS. 10 to 16, the front surface of the protruding portion 83 of the ink supply flow passage forming member 67 is several times as large as the diameter of the through-hole 82. As shown in FIGS. 18 and 19, the through-hole 82' and the protruding portion 83' may be each formed with a conical shape, when seen in section, to decrease the flow passage resistance by the enlarging diameter of the through-hole 82' as well as to increase a flow passage region between the valve member 84 and a wall 83*a*' in the vicinity of the through-hole 82', to thereby further decrease the flow passage resistance.

Figure 20B:
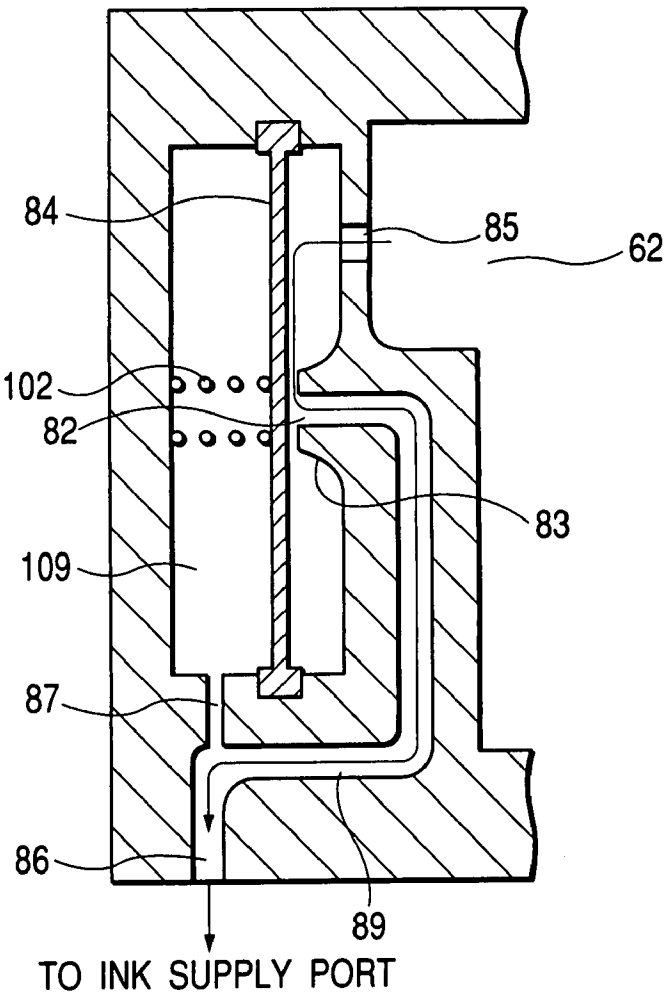
FIGS. 20A and 20B are schematic views, respectively showing a valve closed state and a valve open state of a flow path structure a negative pressure generating mechanism in an ink cartridge according to the present invention.
Figure 20A:
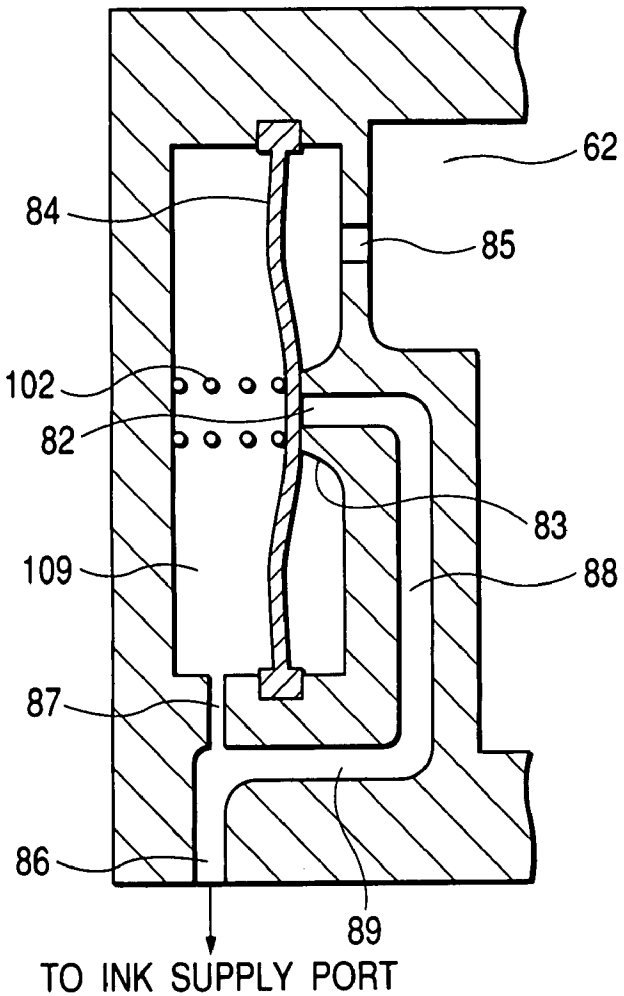

Next, the operation of the negative pressure generating structure of the ink cartridge as described previously with reference to FIGS. 10 to 16 will be further discussed with reference to FIGS. 20A and 20B, which are schematic diagrams depicting additional simplified structure in accordance with the present invention. FIGS. 20A and 20B are schematic diagrams respectively showing a valve closed state and a valve open state with the negative pressure generating structure simplified. For clarity in explanation and in correspondence with the structure of the aforementioned negative pressure generating structure, the same reference numerals are used as were employed in connection with the embodiment shown in FIG. 10 to 16.

In the valve closed state shown in FIG. 20A, the valve member 84 closes the through-hole 82 in response to the biasing force applied thereto by the spring 102, and so the flow of ink from the ink chamber 62 to the ink supply port is blocked. In this state, as when the ink is consumed by the recording head, the pressure in the ink supply port side is correspondingly reduced, so that the thus reduced pressure acts on the valve member 84 via the communication passage 87 and the flow passage 88.

In this embodiment, the back surface side of the valve member 84 communicating with the communication passage 87 faces a compartment 109 that is located between the valve member 84 and the communication passage 87 and which compartment 109 is open for fluid communication to an exterior only via the communication passage 87. That is, the compartment 109 serves as the pressure operating compartment for transmitting the pressure change of the ink supply port to the back surface of the valve member 84.

Accordingly, the back surface of the valve member 84 receives the reduced pressure of the ink supply port side over an open wide area, while the other (front) surface of the valve member 84 receives the reduced pressure of the ink supply port side at a limited area only via the opening 82. For this reason, due to the difference in size between the pressure receiving areas on the front and back surfaces of the valve member 84, a force is exerted in a direction so as to compress the spring 102. When the pressure at the ink supply port side is reduced below a pressure set by the spring 102, the valve member 84 is separated from the protruding portion 83 as shown in FIG. 20B to open the opening 82, whereby the ink in the ink storing chamber 62 flows via the communication passage 85 and the flow passage 88 into the recording head.

During this ink flow, since the ink flows only via the front surface side of the valve member 84, even if an air bubble contained in the ink storing chamber 62 is sucked past the front surface side of the valve member 84, the air bubble flows along with the ink flow into the recording head as it is. That is, since the back surface side of the valve member 84 is constructed to fully-obstruct the closed space (known also as the pressure operating chamber) 109 to prevent high-speed ink flow from the ink chamber 62 through the communication passage 87, the air bubble is unlikely to enter into the communication passage 87 and be disposed by the back surface side of the valve member 84.

Therefore, any pressure change at the ink supply port side acts surely on the back surface of the valve member 84 via the ink to prevent the supply of ink from stopping. In addition, any air bubble entering into the recording head can be easily removed when negative pressure is applied to the recording head to forcibly discharge the ink therefrom, say, during a suction recovery process.

In contrast, in the case of the conventional ink cartridge, in which the valve member 40 is formed as shown in FIG. 7 with the through-hole 41 serving as the ink flow passage, there is a possibility that an air bubble will reach the back surface side of the valve member 40, i.e. the region receiving the pressure of the ink supply port, in which case the presence of the air bubble lowers a driving force applied by the valve member.

Figure 21B:
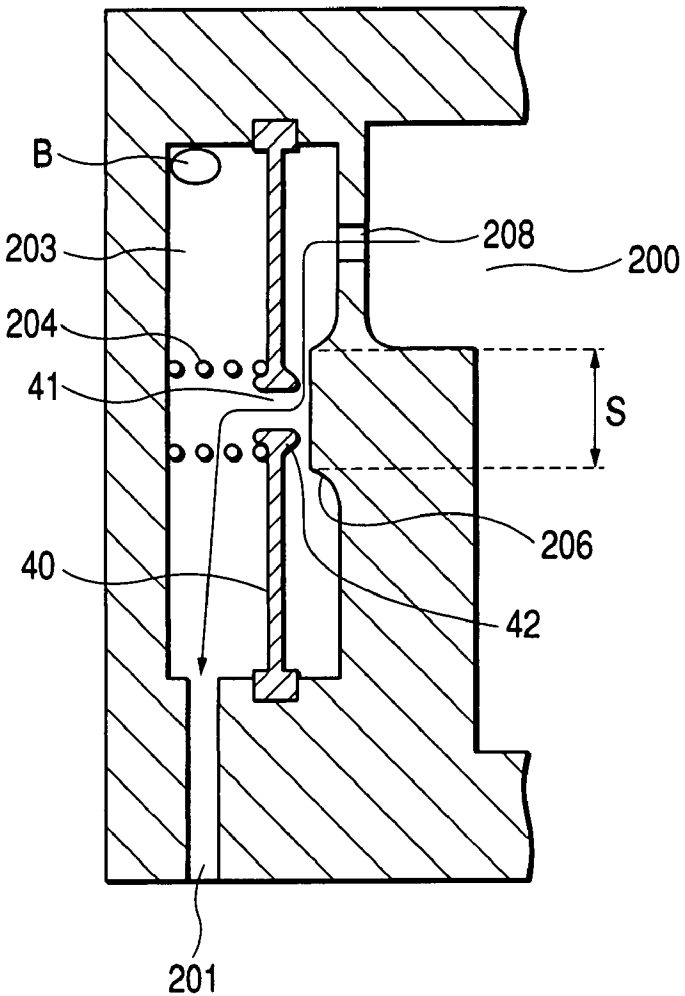
FIGS. 21A and 21B are schematic views, respectively showing a valve closed state and a valve open state of a flow path structure in a negative pressure generating mechanism in a conventional ink cartridge.
Figure 21A:
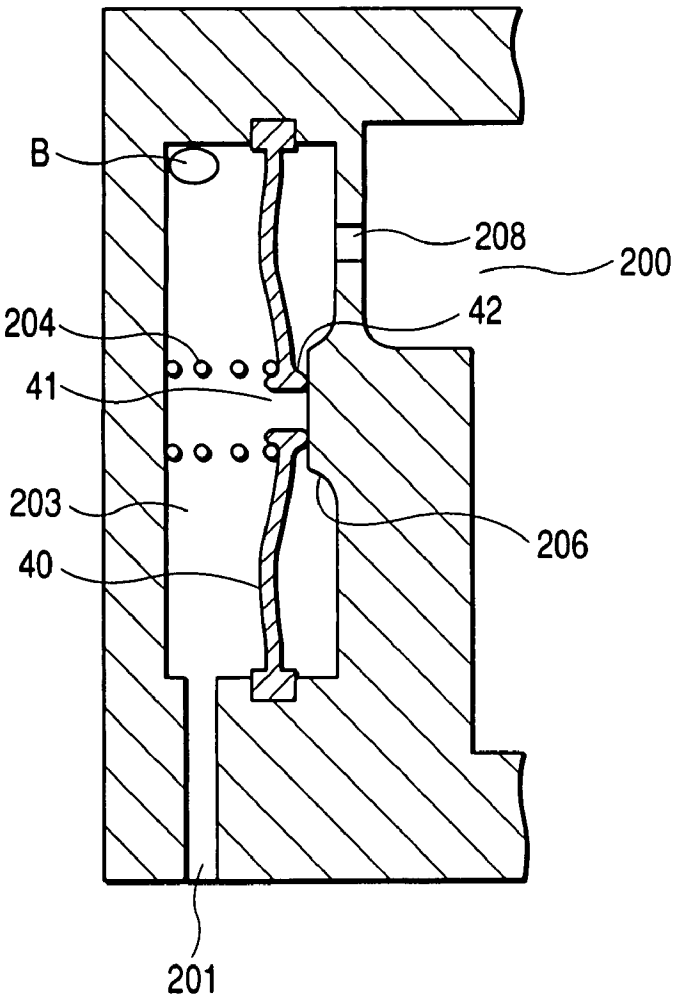

More specifically, FIGS. 21A and 21B are simplified schematic diagrams of the negative pressure generating structure of a conventional ink cartridge. These drawings respectively show a valve closed state and a valve open state. In a state in which the valve member 40 isolates the ink storing region 200 from the ink supply port 201 (FIG. 21A), when the pressure at the ink supply port 201 is reduced, the pressure in the back surface region 203 of the valve member 40 is correspondingly reduced, and so the valve member 40 is urged backwards against the biasing force of the spring 204, as shown in FIG. 21B. When the valve member 40 moves, the through-hole 41 serving as the ink flow passage is separated from the protruding portion 206 and the ink in the ink storing region 200 passes through the through-hole 41 and flows past the back surface region 203 of the valve member 40 into the ink supply port 201. Reference numeral 208 designates a passing hole for communication between the ink storing region 200 and the valve member 40.

During this ink flow, if there is an air bubble B flowing-in from the through-hole 41, the air bubble is likely to stay in the back surface region 203 of the valve member 202. The air bubble B, entering into the back surface region 203 of the valve member 40, i.e. the region receiving the pressure of the ink supply port 201, easily expands to absorb and thereby relieve any reduction in the pressure caused in this region 203, and so the bubble makes it impossible to move the valve member 40 and to supply ink to the recording head.

In view of the fact that the through-hole 41 of the valve member 40 must be sealed by the protruding portion 206, it is preferable to form the through-hole 41 of the valve member 40 in the protruding portion 42. However, it is necessary to make the size S of the protruding portion 206 sealing the through-hole 41 of the valve member 40 large in order to accommodate any possible positional shift of the through-hole 41 caused by deflection of the valve member 40. This creates a problem in that there is increased flow resistance because the area of the protruding portion 206 and therearound is increased and the narrow clearance area between the protruding portion 206 and the valve member 40 is correspondingly large.

In contrast, according to the present invention as shown in FIGS. 20A and 20B, since the opening 82 formed in the protruding portion 83 is sealed, it is sufficient to contact the front surface of the valve member 84 against the opening 82 closely. For this reason, the size of the protruding portion 83 can be made as small as possible to such a degree that the opening portion 82 can be formed. Accordingly, it is possible to decrease the size of the narrow clearance region formed in the vicinity of the opening 82 between the valve member 84 and the protruding portion 83, to thereby reduce the flow passage resistance.

Figure 22B:
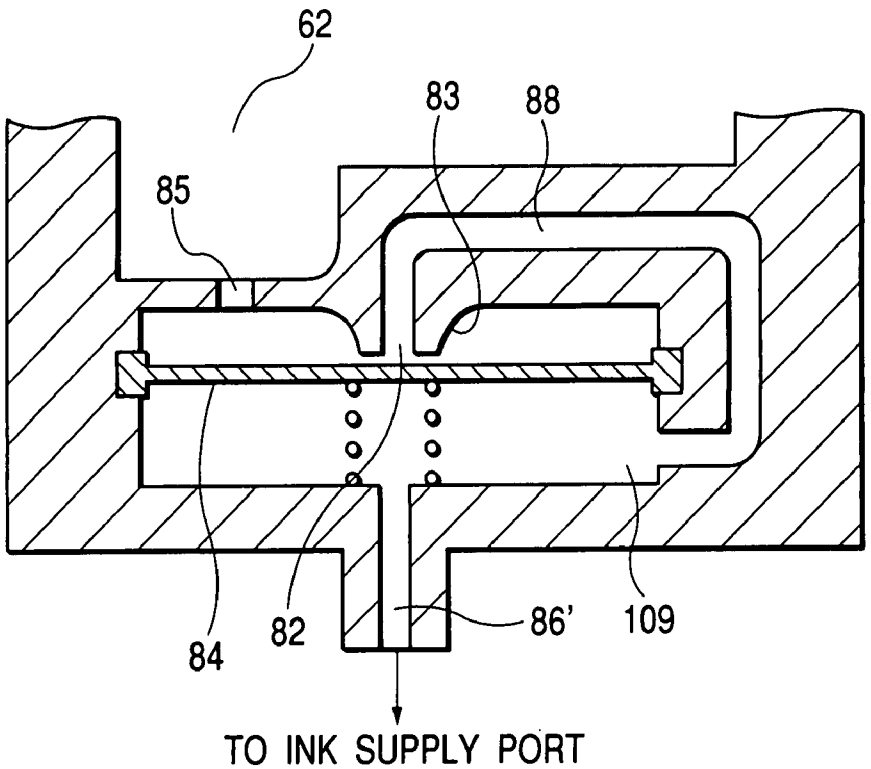
FIGS. 22A and 22B show other embodiments of a flow path structure in the negative pressure generating mechanism in the ink cartridge according to the present invention.
Figure 22A:
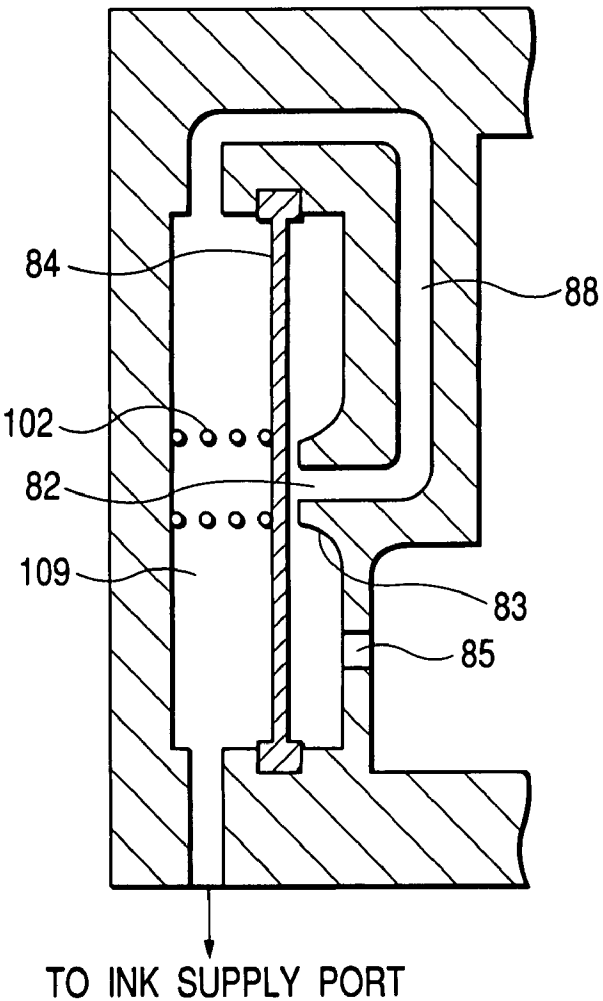

In the aforementioned embodiment, the back surface side of the valve member 84 is constructed to face and block off the closed space 109 that communicates with the exterior only via the communication passage 87. However, the invention is not restricted thereto or thereby. For example, as shown in FIG. 22A or 22B, the flow passage 88 for fluid communication between the opening 82 and the ink supply port may be connected to one end of the closed space 109 behind the valve member 84, and a flow passage for fluid communication with the ink supply port may be provided to the pressure operating compartment, so that the back surface region of the valve member 84 serves as an ink flow passage. In addition, the vertical arrangement of the valve member 84 as shown in FIG. 22A helps to insure any bubble passing through opening 85 will float upward along the valve member to the top of the chamber and not be drawn into opening 82.

By forming an ink outflow passage 86' that communicates with the pressure operating compartment 109 behind the valve member 84 and that is perpendicular to the surface of the valve member 84, as shown in FIG. 22B, it is possible to use the ink cartridge with the valve member 84 in a horizontal orientation.

Figure 23:
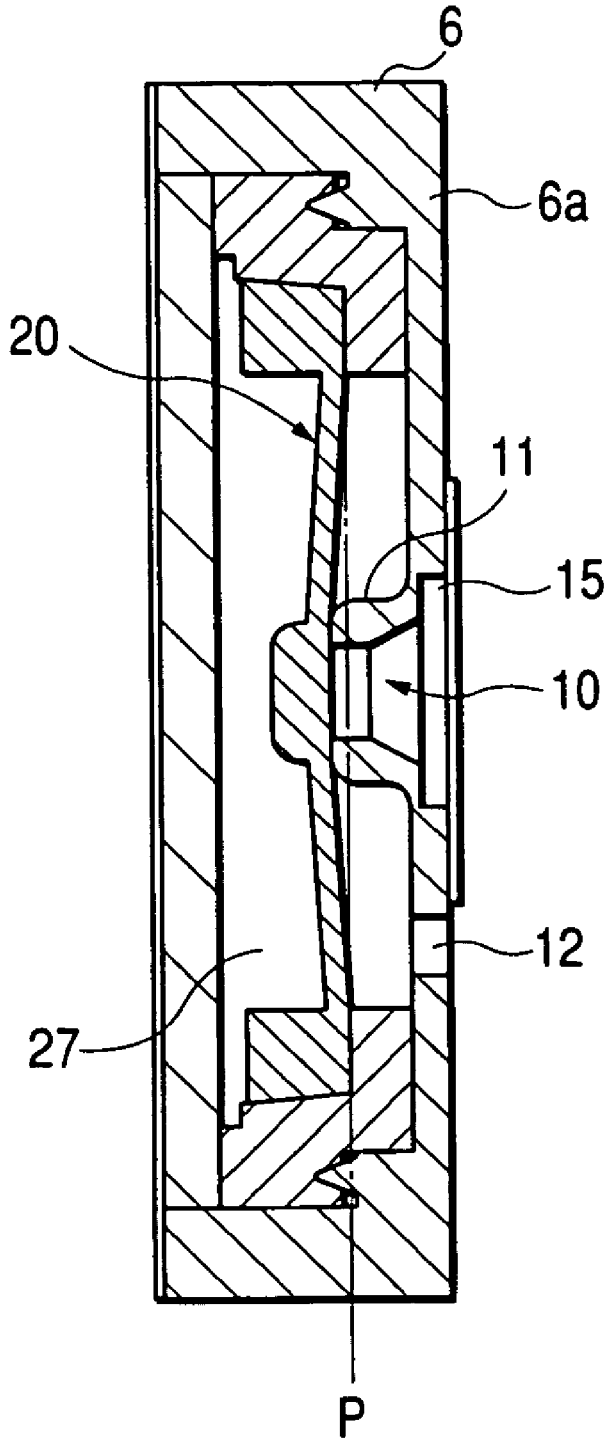
FIG. 23 is a sectional view showing another embodiment of the negative pressure generating mechanism.

In addition, taking, for instance, the embodiment shown in FIG. 4 as an example, the differential pressure adjusting spring 22 is disposed on the back surface of the valve member 20 and urges the valve member 20 so that the valve member 20 is in elastic contact with the protruding portion 11. The present invention should not, however, be restricted thereto or thereby. For example, as shown in FIG. 23, the valve member 20 may be made of elastic material, such as a rubber, and the protruding portion 11 may be relatively projected toward the valve member 20 side beyond a plane P that is formed by the undeformed valve body 20 itself in the protruding portion's absence. In this case, the valve member 20 can be maintained in elastic contact with the protruding portion 11 through the inherent elasticity of the valve member 20 itself. This way, a biasing member, such as the spring 22, can be dispensed with.

Alternatively, the valve body 20 can be biased through the combination of its own deformation against a protruding portion 11 together with a suitably positioned biasing spring.

Although the present invention has been described with reference to an ink cartridge that can be detachably mounted to the recording head, the present invention is applicable to an ink tank (an ink cartridge) of a type in which a recording head is fixed to an ink storing member such as the ink tank. In this case, the ink supply port discussed above encompasses a boundary area at which the ink storing member is connected to the recording head, that is, the ink supply port means an ink inflow port or portion of the recording head.

Figure 24:
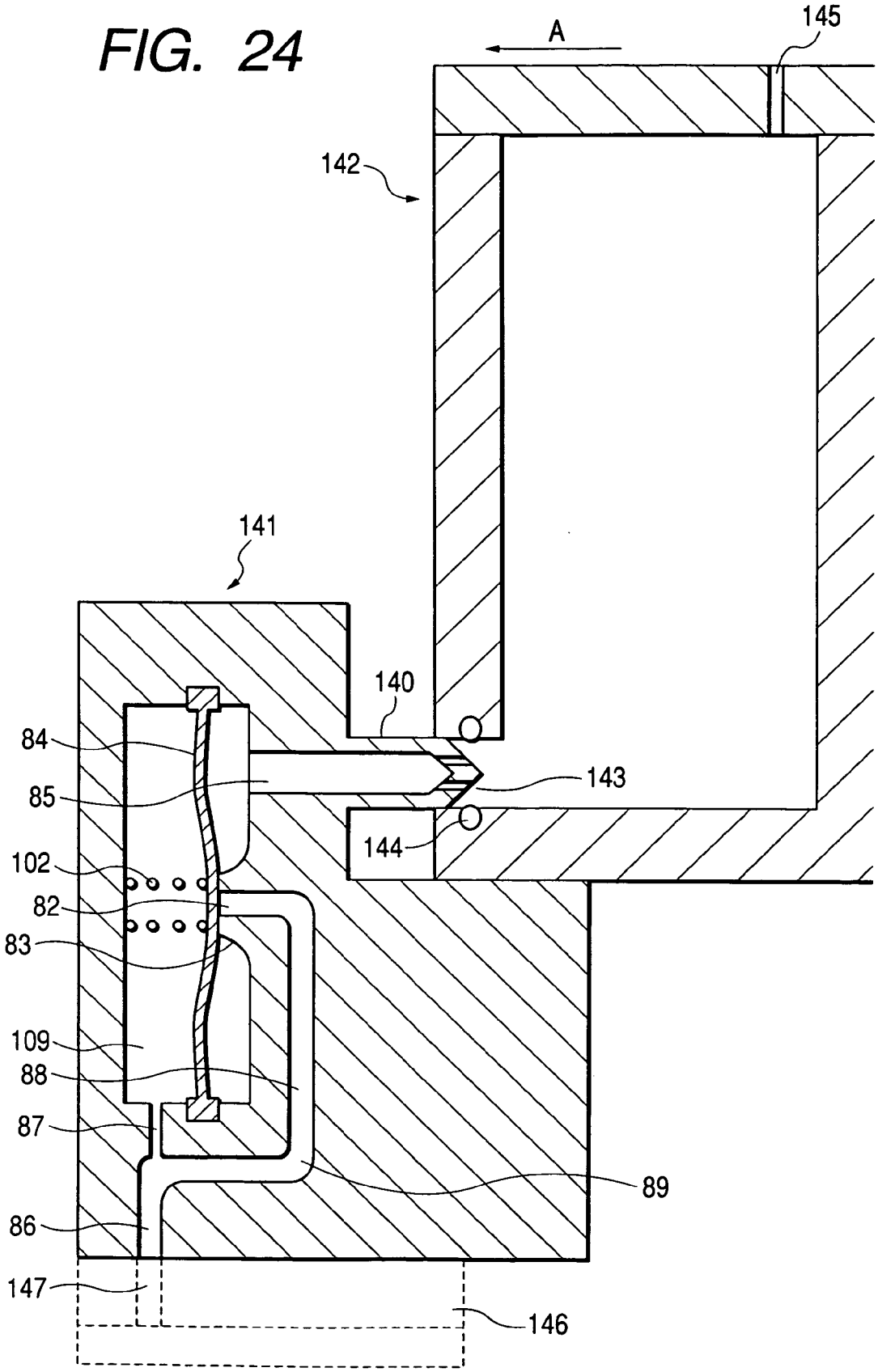
FIG. 24 is a sectional view showing an embodiment of a fluid flow controller for a recording head, which employs the principles of the present invention.

FIG. 24 shows an embodiment of a fluid flow controller or a liquid supply device that positively employs the operation principle of the valve member as mentioned above to supply ink to a recording head, while maintaining a negative pressure in the passage 86 from which ink flows to the ink inkflow port 147 of the recording head. In this embodiment, the region immediately upstream of the valve member 84 (that is, the region corresponding to the ink storing chamber 62 of FIGS. 20A and 20B) is omitted, and instead, a connection member, such as the hollow needle 140 shown in this embodiment, is provided to construct a valve structure device 141. The valve structure device 141 is detachably connectable to an external device, such as an ink tank or ink container 142 storing ink therein, via the connection member.

The ink container 142 is formed at its lower portion with an ink outflow port 143 that is engageable in liquid-tight fashion with the hollow needle 140. In the case of a new, unused ink container 142, a sealing film (not shown) that can be pieced by the hollow needle 140 seals the ink outflow port 143 in order to prevent the leakage of ink. In addition, reference numeral 144 in the drawing designates an annular packing adapted to be elastically contacted with the outer circumference of the hollow needle 140. Reference numeral 145 designates an atmosphere communication hole.

The portions of this invention necessary for the valve member 84 to function as discussed above can be provided in the form of an independent device, i.e. the valve structure device 141. In this arrangement, the recording head 146 is fixed to the bottom portion of the valve structure device 141, and the ink inflow port 147 of the recording head 146 is connected to the ink outflow port (the flow passage designated by reference numeral 86) of the valve structure device 141. The ink container 142 can be mounted by inserting the ink container 142 in the direction indicated by arrow A to supply ink to the recording head 146, and can be replaced by moving and withdrawing the ink container 142 in the opposite direction.

In addition, the operation and effect of the valve structure device 141 in this embodiment is the same as the aforementioned embodiments, and therefore the valve structure device 141, when integrated with the ink container 142, functions in the same manner as the ink cartridge described above.

Although the ink container 142 is directly connected (mounted) to the connection member (the hollow needle 140) in the embodiment mentioned above, the same effect can be obtained when the connection member is connected via a tube to an ink cartridge installed in a main body of the recording apparatus.

Although the present invention has been described and illustrated in detail, it is clearly understood that the same is by way of illustration and example only and is not to be taken by way of limitation, the spirit and scope of the present invention being defined only by the terms of the accompanying claims.

The invention claimed is:

1. An ink jet recording apparatus, comprising:

a print head unit;

an ink supply needle an ink cartridge for detachable mounting to the ink supply needle, and having an ink storage chamber and an ink supply port that receives the ink supply needle when the ink cartridge is mounted; and a flow controller contained within the ink cartridge, the flow controller comprising:

a housing having a floor having an inner side and an outer side, an inlet opening in the floor running between the inner and outer sides and which is in fluid communication with the ink storage chamber, a perimeter wall extending from inner side of the floor, a projection extending from the inner side of the floor, the projection having an outlet therethrough, and a groove formed in the outer side that is in fluid communication with both the outlet and the ink supply;

a cover contacting the perimeter wall;

an elastic member disposed between the cover and the inner side of the floor; and an urging member located between the cover and the elastic member, the urging member applying force to the elastic member to press the elastic member toward the projection, wherein said print head unit is in fluid communication with said ink cartridge, so that ink in the ink storage chamber can flow through the flow controller and the ink supply needle to the print head unit.

2. An ink jet recording apparatus according to claim 1, wherein the elastic member includes a flat portion that obstructs the opening portion.

3. An ink jet recording apparatus according to claim 1, wherein the elastic member includes an edge portion that is held in place by a cover.

4. An ink jet recording apparatus according to claim 1, wherein the elastic member separates from the opening portion when the elastic member experiences a pressure that is greater than a pressure exerted on the elastic member just by the ink in the ink storage chamber.

5. An ink jet recording apparatus according to claim 1, wherein the elastic member separates from the opening portion when the ink downstream of the elastic member establishes a pressure difference larger than a predetermined pressure difference relative to the ink in the ink storage chamber due to ink consumption by the ink-jet recording apparatus.

6. An ink jet recording apparatus according to claim 1, wherein the elastic member separates from the opening portion as a result of a pressure difference between said ink storage chamber and said ink supply port due to ink consumption by the ink jet recording head.

7. An ink jet recording apparatus according to claim 1, wherein the opening portion is part of a projection.

8. An ink jet recording apparatus according to claim 1, wherein the elastic member is deformed so that the elastic member presses against the opening portion to prevent the elastic member from separating from the opening portion under pressure exerted just by the ink in the ink storage chamber.

9. An ink jet recording apparatus according to claim 1, wherein the opening portion faces a center of the elastic member.

10. An ink jet recording apparatus according to claim 1, wherein the inlet is offset from the outlet in a first direction.

11. An ink jet recording apparatus according to claim 1, wherein the recording apparatus has plural said ink cartridges.

12. An ink jet recording apparatus, comprising:

a print head unit;

an ink supply needle;

an ink source for supplying ink to the ink jet recording apparatus, the ink source including an ink cartridge for detachable mounting to the ink supply needle, and having an ink storage chamber and an ink supply port that receives the ink supply needle when the ink cartridge is mounted; and a flow controller contained within the ink cartridge, the flow controller comprising:

a housing having a floor having an inner side and an outer side, an inlet opening in the floor running between the inner and outer sides and which is in fluid communication with the ink storage chamber, a perimeter wall extending from inner side of the floor, a projection extending from the inner side of the floor, the projection having an outlet therethrough, and a groove formed in the outer side that is in fluid communication with both the outlet and the ink supply port;

a cover contacting the perimeter wall;

an elastic member disposed between the cover and the inner side of the floor; and an urging member located between the cover and the elastic member, the urging member applying force to the elastic member to press the elastic member toward the projection, wherein said print head unit is in fluid communication with said ink cartridge, so that ink in the ink storage chamber can flow through the flow controller and the ink supply needle to the print head unit.

13. An ink jet recording apparatus according to claim 12, wherein the recording apparatus has plural said ink cartridges.

14. An ink jet recording apparatus, comprising:

a print head unit;

an ink supply needle;

an ink supply, comprising an ink cartridge for detachable mounting to the ink supply needle, and having an ink storage chamber and an ink supply port that receives the ink supply needle when the ink cartridge is mounted; and a flow controller contained within the ink cartridge, the flow controller comprising:

a housing having a floor having an inner side and an outer side, an inlet opening in the floor running between the inner and outer sides and which is in fluid communication with the ink storage chamber, a perimeter wall extending from inner side of the floor, a projection extending from the inner side of the floor, the projection having an outlet therethrough, and a groove formed in the outer side that is in fluid communication with both the outlet and the ink supply port;

a cover contacting the perimeter wall; and an elastic member disposed between the cover and the inner side of the floor;

an urging member located between the cover and the elastic member, the urging member applying force to the elastic member to press the elastic member toward the projection, wherein said print head unit is in fluid communication with said ink cartridge, so that ink in the container can flow through the flow controller and the ink supply needle to the print head unit.

15. An ink jet recording apparatus according to claim 14, wherein the recording apparatus has plural said ink cartridges.

* * * * *